US008235482B2

(12) United States Patent
Katada

(10) Patent No.: US 8,235,482 B2
(45) Date of Patent: Aug. 7, 2012

(54) LIQUID EJECTION APPARATUS, IMAGE FORMING APPARATUS AND LIQUID STORAGE AMOUNT JUDGMENT METHOD

(75) Inventor: Masahito Katada, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 985 days.

(21) Appl. No.: 12/176,851

(22) Filed: Jul. 21, 2008

(65) Prior Publication Data

US 2009/0027435 A1 Jan. 29, 2009

(30) Foreign Application Priority Data

Jul. 25, 2007 (JP) ..... 2007-193714

(51) Int. Cl.
*B41J 29/38* (2006.01)

(52) U.S. Cl. ..... 347/6; 347/7; 347/19; 347/85; 347/86

(58) Field of Classification Search ..... None
See application file for complete search history.

(56) References Cited

U.S. PATENT DOCUMENTS

| | | | | |
|---|---|---|---|---|
| 4,604,633 | A | 8/1986 | Kimura et al. | |
| 5,847,736 | A * | 12/1998 | Kanbayashi et al. | 347/89 |
| 6,378,971 | B1 | 4/2002 | Tamura et al. | |
| 6,454,375 | B2 * | 9/2002 | Wilson et al. | 347/7 |
| 6,582,068 | B2 | 6/2003 | Ishizawa et al. | |
| 6,644,794 | B1 | 11/2003 | Wilson et al. | |
| 6,758,556 | B2 | 7/2004 | Ishizawa et al. | |
| 6,796,627 | B2 | 9/2004 | Kimura et al. | |
| 6,834,945 | B2 | 12/2004 | Ishizawa et al. | |
| 6,874,876 | B2 | 4/2005 | Ishizawa et al. | |
| 6,886,929 | B2 * | 5/2005 | Malik et al. | 347/86 |
| 6,988,793 | B2 | 1/2006 | Wilson et al. | |
| 7,152,965 | B2 | 12/2006 | Ishizawa et al. | |
| 7,380,909 | B2 | 6/2008 | Ishizawa et al. | |
| 7,407,241 | B2 | 8/2008 | Mutoh et al. | |
| 7,566,120 | B2 | 7/2009 | Ishizawa et al. | |

(Continued)

FOREIGN PATENT DOCUMENTS

| | | | |
|---|---|---|---|
| JP | 59-104947 | A | 6/1984 |
| JP | 2001-212974 | A | 8/2001 |
| JP | 2002-160385 | A | 6/2002 |
| JP | 2003-300331 | A | 10/2003 |
| JP | 2006-62329 | A | 3/2006 |

*Primary Examiner* — Uyen Chau N Le
*Assistant Examiner* — Chad Smith
(74) *Attorney, Agent, or Firm* — Birch, Stewart, Kolasch & Birch, LLP

(57) ABSTRACT

The liquid ejection apparatus has: a sub tank having a liquid chamber which stores liquid, a gas chamber which fills with gas, and a flexible film which divides the liquid chamber from the gas chamber; a liquid tank which is connected to the liquid chamber and stores the liquid; a liquid conveyance device which conveys the liquid between the liquid chamber and the liquid tank; an ejection head connected to the liquid chamber; a control device which carries out control in such a manner that pressure in the gas chamber is controlled to control back pressure of the liquid in the ejection head; a liquid pressure determination device which determines pressure in the liquid chamber; a gas pressure determination device which determines the pressure in the gas chamber; and a liquid storage amount judgment device which judges whether or not an amount of the liquid stored in the liquid chamber is within a tolerable range in which the back pressure of the liquid in the ejection head can be controlled, according to a gas-liquid pressure differential which is a difference between the pressure of the liquid chamber determined by the liquid pressure determination device and the pressure of the gas chamber determined by the gas pressure determination device.

9 Claims, 17 Drawing Sheets

U.S. PATENT DOCUMENTS 7,784,923 B2 8/2010 Ishizawa et al.
2007/0182772 A1* 8/2007 Matsumoto et al. ..... 347/7
2008/0024555 A1* 1/2008 Kimura ..... 347/50
2010/0283821 A1 11/2010 Ishizawa et al.

* cited by examiner

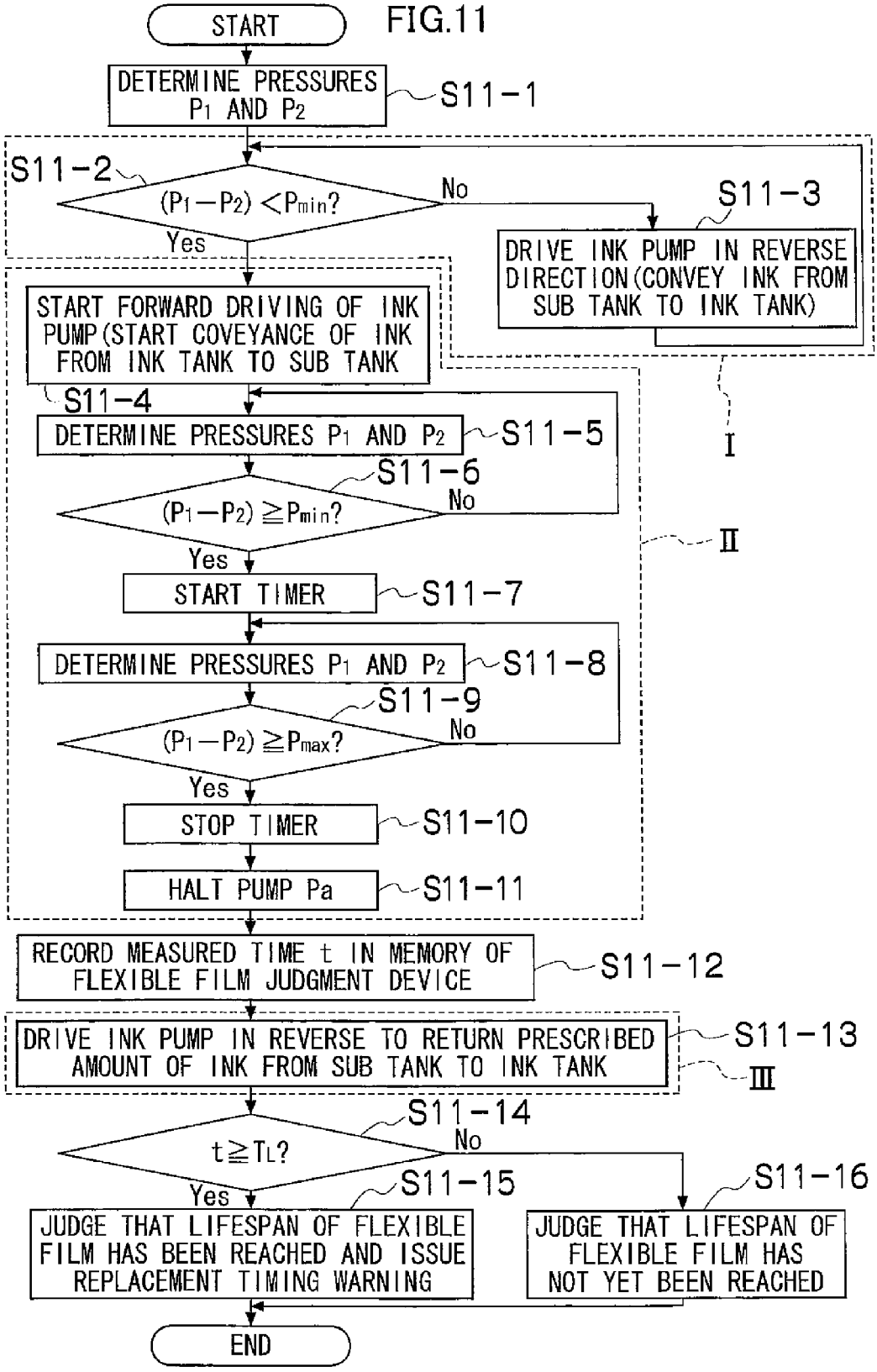
START
FIG.11
DETERMINE PRESSURES P1 AND P2
S11-1
S11-2
(P1−P2) <Pmin?
No
S11-3
Yes
DRIVE INK PUMP IN REVERSE DIRECTION(CONVEY INK FROM SUB TANK TO INK TANK)
START FORWARD DRIVING OF INK PUMP(START COVEYANCE OF INK FROM INK TANK TO SUB TANK
S11-4
DETERMINE PRESSURES P1 AND P2
S11-5
I
S11-6
(P1−P2) ≧Pmin?
No
II
Yes
START TIMER
S11-7
DETERMINE PRESSURES P1 AND P2
S11-8
S11-9
(P1−P2) ≧Pmax?
No
Yes
STOP TIMER
S11-10
HALT PUMP Pa
S11-11
RECORD MEASURED TIME t IN MEMORY OF FLEXIBLE FILM JUDGMENT DEVICE
S11-12
DRIVE INK PUMP IN REVERSE TO RETURN PRESCRIBED AMOUNT OF INK FROM SUB TANK TO INK TANK
S11-13
III
S11-14
t≧TL?
No
Yes
S11-15
S11-16
JUDGE THAT LIFESPAN OF FLEXIBLE FILM HAS BEEN REACHED AND ISSUE REPLACEMENT TIMING WARNING
JUDGE THAT LIFESPAN OF FLEXIBLE FILM HAS NOT YET BEEN REACHED
END

LIQUID EJECTION APPARATUS, IMAGE FORMING APPARATUS AND LIQUID STORAGE AMOUNT JUDGMENT METHOD

BACKGROUND OF THE INVENTION

1. Field of the Invention

The present invention relates to a liquid ejection apparatus, an image forming apparatus and a liquid storage amount judgment method, and more particularly, to a liquid ejection apparatus used in an inkjet type recording apparatus.

2. Description of the Related Art

In the related art, there is technology for controlling the back pressure by applying a negative pressure to the nozzle section, in order to prevent leakage of ink from the nozzles of a recording head. The following invention has been disclosed as apparatuses for controlling the back pressure of a recording head.

The invention disclosed in Japanese Patent Application Publication No. 2003-300331 comprises: an ink bag connected to a recording head, a seal device which hermetically encloses the ink bag, a suctioning device which performs suctioning to create a negative pressure in the space between the seal device and the ink bag, and a negative pressure determination device which determines the pressure of the space between the seal device and the ink bag.

The negative pressure determination device determines the state of negative pressure change in the space between the seal device and the ink bag when a negative pressure is created by the suctioning device, so that the residual amount of ink in the ink bag is determined. Then, the back pressure of the recording head is controlled on the basis of the residual amount of ink thus determined.

Furthermore, the invention described below has been disclosed as a device for determining the liquid pressure of the ink, and the remaining amount of ink, inside a recording head.

In the invention disclosed in Japanese Patent Application Publication No. 59-104947, one portion of the wall of an ink supply channel inside a recording head is constituted by a flexible film, and by determining the displacement of this flexible film, the pressure and remaining amount of the ink inside the recording head are determined.

However, although the invention disclosed in Japanese Patent Application Publication No. 2003-300331 determines the pressure in the space between a seal device and an ink bag by means of a negative pressure determination device, it does not determine the pressure of the ink inside the ink bag. Therefore, when determining the remaining amount of ink, it is necessary to halt the ejection of ink from the recording head and set the pressure of the ink inside the ink bag to a uniform pressure. Consequently, the accuracy of determining the remaining amount of ink declines when ink is being ejected from the recording head, and there is a possibility that the back pressure of the recording head cannot be controlled stably.

Moreover, in the invention disclosed in Japanese Patent Application Publication No. 59-104947, the flexible film deteriorates due to the application of repeated displacement of the flexible film. When the flexible film deteriorates, the determination accuracy of the ink pressure and the determination accuracy of the remaining amount of ink decline. In particular, in the case of a recording head which is used in a recording apparatus that consumes a large amount of ink, the amount of deformation of the flexible film and the number of deformations of the film tend to increase, and therefore, the load applied to the flexible film becomes larger and there is a possibility that deterioration will occur more rapidly.

SUMMARY OF THE INVENTION

The present invention has been contrived in view of the foregoing circumstances, an object thereof being to provide a liquid ejection apparatus in which the judgment accuracy of the amount of liquid stored in a liquid chamber can be raised and the back pressure can be controlled in a stable fashion.

In order to attain the aforementioned object, the present invention is directed to a liquid ejection apparatus, comprising, a sub tank having a liquid chamber which stores liquid, a gas chamber which fills with gas, and a flexible film which divides the liquid chamber from the gas chamber; a liquid tank which is connected to the liquid chamber and stores the liquid; a liquid conveyance device which conveys the liquid between the liquid chamber and the liquid tank; an ejection head connected to the liquid chamber; a control device which carries out control in such a manner that pressure in the gas chamber is controlled to control back pressure of the liquid in the ejection head; a liquid pressure determination device which determines pressure in the liquid chamber; a gas pressure determination device which determines the pressure in the gas chamber; and a liquid storage amount judgment device which judges whether or not an amount of the liquid stored in the liquid chamber is within a tolerable range in which the back pressure of the liquid in the ejection head can be controlled, according to a gas-liquid pressure differential which is a difference between the pressure of the liquid chamber determined by the liquid pressure determination device and the pressure of the gas chamber determined by the gas pressure determination device.

In this aspect of the invention, the respective pressures of the liquid chamber and the gas chamber are determined, and the pressure differential between the liquid chamber and the gas chamber is used to judge whether or not the amount of liquid stored in the liquid chamber is within a tolerable range in which the back pressure can be controlled. Therefore, even in circumstances where the liquid storage amount in the liquid chamber changes, such as during replenishment of liquid or during consumption of liquid, it is possible to enhance the judgment accuracy of the liquid storage amount in the liquid chamber.

Desirably, the liquid storage amount judgment device sets a range of a gas-liquid pressure differential in which the flexible film can bend freely, and judges that the amount of liquid stored in the liquid chamber reaches a limit value of the tolerable range, when the gas-liquid pressure differential exceeds a limit value of the set range.

In this aspect of the invention, even in circumstances where the liquid storage amount in the liquid chamber changes, such as during replenishment of liquid or during consumption of liquid, it is still possible to judge whether or not the liquid storage amount in the liquid chamber has reached a limit value of the tolerable range in which the back pressure can be controlled.

Desirably, the liquid conveyance device carries out replenishment supply to convey the liquid from the liquid tank to the liquid chamber, and return supply to convey the liquid from the liquid chamber to the liquid tank; and when the liquid storage amount judgment device judges that the amount of liquid stored in the liquid chamber has reached an upper limit value of the tolerable range due to the replenishment supply, the control device carries out the control in such a manner that the liquid conveyance device halts the replenishment supply and carries out the return supply.

In this aspect of the invention, it is possible to increase the lifespan of the flexible film by alleviating the load applied to the flexible film, while also controlling the back pressure in a stable fashion.

Desirably, the control device carries out the control in such a manner that a speed of the liquid conveyed from the liquid tank to the liquid chamber during the replenishment supply is substantially uniform or is varied periodically.

In this aspect of the invention, it is possible to convey the liquid from the liquid tank to the liquid chamber in a stable fashion. Furthermore, by controlling the speed so as to change periodically, it is possible to apply a periodic variation to the flexible film and thereby any bubbles or foreign material adhering thereto becomes more liable to be detached.

Desirably, the liquid droplet ejection apparatus further comprises a flexible film deterioration judgment device which determines liquid replenishment time that is a time period required for the amount of liquid stored in the liquid chamber to vary from a lower limit value to an upper limit value of the tolerable range by means of the replenishment supply, and which judges a state of deterioration of the flexible film according to the determined liquid replenishment time.

In this aspect of the invention, it is possible to determine the deterioration of the flexible film.

Desirably, when the liquid replenishment time exceeds a prescribed value $T_L$, the flexible film deterioration judgment device judges that a lifespan of the flexible film is reached in terms of the state of deterioration of the flexible film.

In this aspect of the invention, it is possible to determine the lifespan of the flexible film.

Desirably, the liquid ejection apparatus further comprises a warning device which issues a warning that replacement timing of the flexible film is reached, when the flexible film deterioration judgment device judges that the lifespan of the flexible film is reached in terms of the state of deterioration of the flexible film.

Desirably, the control device controls an amount of the liquid conveyed in the return supply in accordance with the liquid replenishment time.

In this aspect of the invention, it is possible to increase the lifespan of the flexile film by lessening the load applied to the flexible film, while ensuring a uniform amount of liquid in the liquid chamber.

In order to attain the aforementioned object, the present invention is also directed to an image forming apparatus comprising any one of the above-described liquid ejection apparatuses.

In order to attain the aforementioned object, the present invention is also directed to a liquid storage amount judgment method of judging an amount of liquid stored in a liquid chamber of a sub tank having the liquid chamber which stores the liquid, a gas chamber which fills with gas, and a flexible film which divides the liquid chamber from the gas chamber, the liquid storage amount judgment method comprising: a liquid pressure determination step of determining pressure in the liquid chamber; a gas pressure determination step of determining pressure in the gas chamber; a liquid storage amount judgment step of judging whether or not an amount of the liquid stored in the liquid chamber is within a tolerable range in which back pressure of the liquid in an ejection head connected to the liquid chamber can be controlled by controlling the pressure in the gas chamber, according to a gas-liquid pressure differential which is a difference between the pressure of the liquid chamber determined in the liquid pressure determination step and the pressure of the gas chamber determined in the gas pressure determination step.

According to the present invention, it is possible to improve judgment accuracy in respect of the amount of liquid stored in a liquid chamber to control the back pressure in a stable fashion.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 11 is a flowchart diagram of a method of judging the state of deterioration of the flexible film;

DETAILED DESCRIPTION OF THE PREFERRED EMBODIMENTS

Description of Liquid Ejection Apparatus

Figure 1:
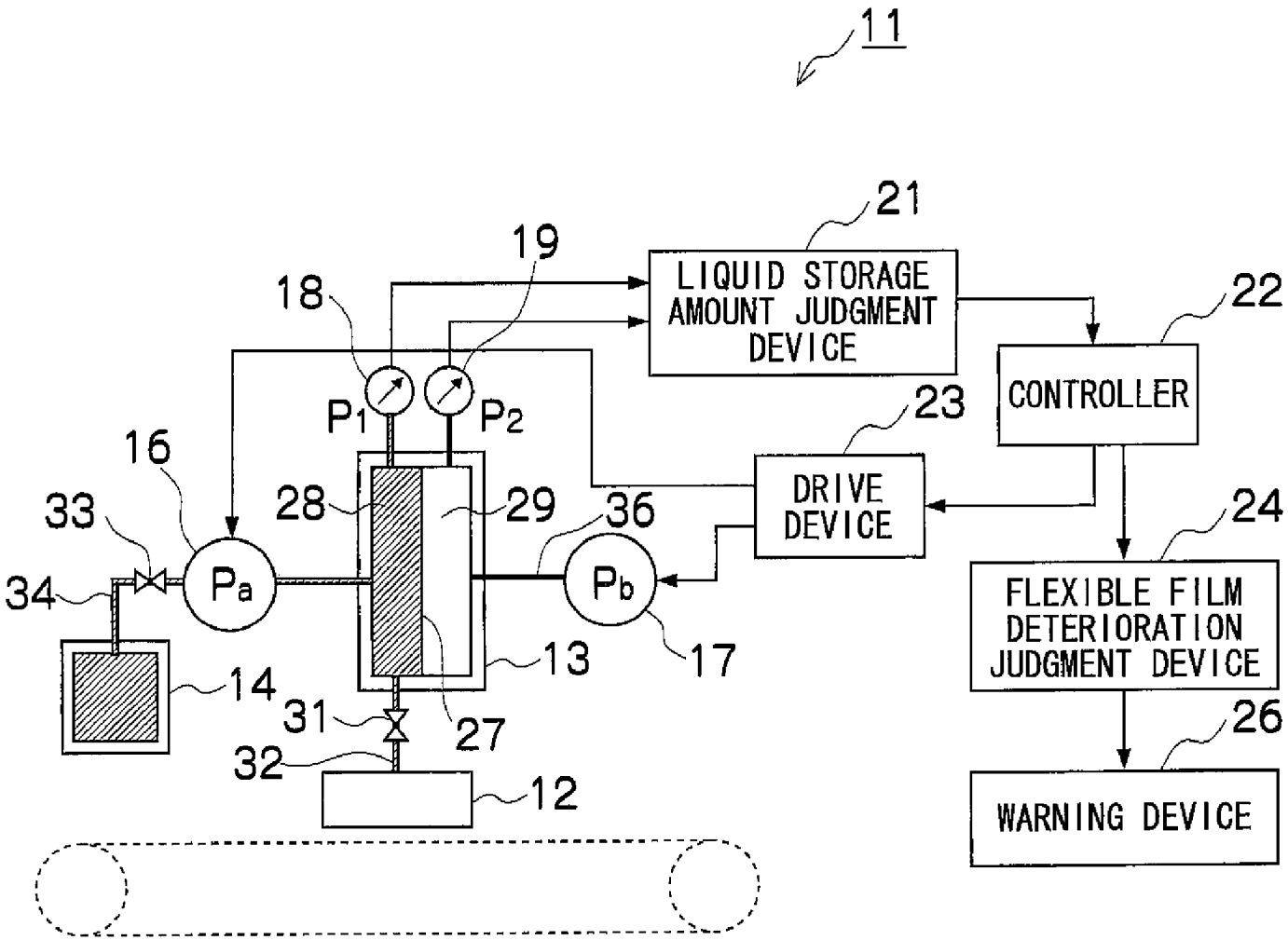
FIG. 1 is a general view of a liquid ejection apparatus according to an embodiment of the present invention.

FIG. 1 is a general schematic diagram of a liquid ejection apparatus according to an embodiment of the present invention. As shown in FIG. 1, the liquid ejection apparatus according to the embodiment of the present invention comprises, for example, a recording head 12 (ejection head), a sub tank 13, an ink tank 14 (liquid tank), an ink pump 16 (liquid conveyance device), a gas pump 17, an ink chamber pressure gauge 18 (liquid pressure determination device), a gas chamber pressure gauge 19 (gas pressure determination device), a liquid storage amount judgment device 21, a controller 22 (control device), a drive device 23, a flexible film deterioration judgment device 24, a warning device 26, and the like.

Nozzles 151 which are described below are formed in the recording head 12, and ink is ejected from these nozzles 151. These elements are described in more detail below.

The sub tank 13 comprises a flexible film 27 provided inside a tank which forms a hermetically sealed container, and the interior of the tank is divided into an ink chamber 28 (liquid chamber) and a gas chamber 29 by means of the flexible film 27. The flexible film 27 may be a film membrane, or an elastic membrane, or the like. The ink chamber 28 is connected to the recording head 12 by a connection channel 32, via a valve 31, and it is also connected to the ink tank 14 by a connection channel 34 via the ink pump 16 and a valve 33. Furthermore, the pressure of the ink inside the ink chamber 28 is determined by the ink chamber pressure gauge 18. The gas chamber 29 is connected to the gas pump 17 via the connection channel 36. Moreover, the pressure of the gas inside the gas chamber 29 is determined by the gas chamber pressure gauge 19.

Accordingly, the pressure $P_1$ of the ink chamber 28 is determined by the ink chamber pressure gauge 18, and the inflow and outflow of gas in the gas chamber 29 created by the gas pump 17 is controlled in order to control the back pressure in such a manner that the pressure $P_1$ of the ink chamber 28 becomes a prescribed back pressure value. Consequently, a back pressure is applied to the ink in the recording head 12. The pressure of the sub tank 13 can be adjusted accordingly, and the sub tank 13 is provided above the recording head 12 and the connection channel 32 between the sub tank 13 and the recording head 12 can be shortened in order to reduce any variations in the back pressure caused by variation in the pressure loss in the flow channel.

The ink tank 14 stores ink for replenishment of the ink chamber 28 of the sub tank 13.

The liquid storage amount judgment device 21 is a device of determining the amount of ink stored inside the ink chamber 28 of the sub tank 13, on the basis of the ink pressure determination data obtained from the ink chamber pressure gauge 18, and the gas pressure determination data obtained from the gas chamber pressure gauge 19.

The controller 22 controls the pressure in the gas chamber 29 so as to control the back pressure of the ink inside the recording head 12. Furthermore, it creates drive data to be supplied to the drive device 23 to control the ink pump 16 and the gas pump 17, on the basis of the data about the amount of ink stored in the ink chamber 28 of the sub tank 13, as judged by the liquid storage amount judgment device 21. Furthermore, the drive data for the ink pump 16 thus created is supplied to the flexible film deterioration judgment device 24.

The flexible film deterioration judgment device 24 is a device of judging the state of deterioration of the flexible film 27, on the basis of the drive data for the ink pump 16 created by the controller 22 and supplied to the drive device 23, and of supplying data on the judgment results to the warning device 26. The warning device 26 is a device which issues a warning about the replacement timing of the flexible film 27, and it may be, for instance, a display device, an alarm source generating device, or the like.

Judgment of Liquid Storage Amount

Figure 2:
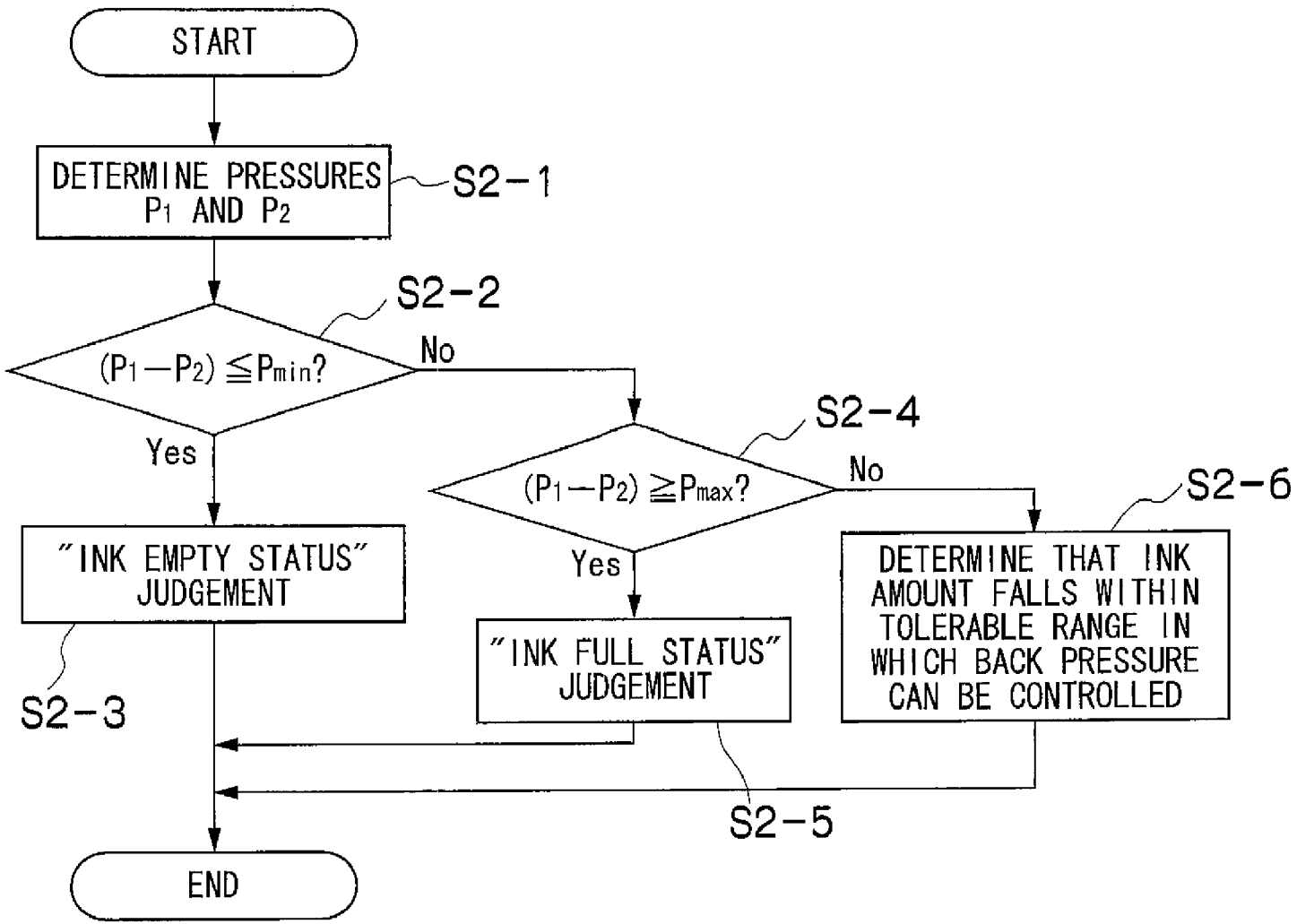
FIG. 2 is a flowchart diagram relating to judgment of the ink storage amount in an ink chamber in a sub tank.

FIG. 2 is a flowchart of the judgment of the ink storage amount in the ink chamber 28 of the sub tank 13. As shown in FIG. 2, when the flowchart is started, firstly, the pressure $P_1$ inside the ink chamber 28 is determined by the ink chamber pressure gauge 18, and the pressure $P_2$ in the gas chamber 29 is determined by the gas chamber pressure gauge 19 (step S2-1).

Next, the liquid storage amount judgment device 21 determines the pressure differential ($P_1-P_2$), which is the gas/liquid pressure difference, on the basis of the determination data for the pressure $P_1$ in the ink chamber 28 and the determination data for the pressure $P_2$ in the gas chamber 29.

Figure 3:
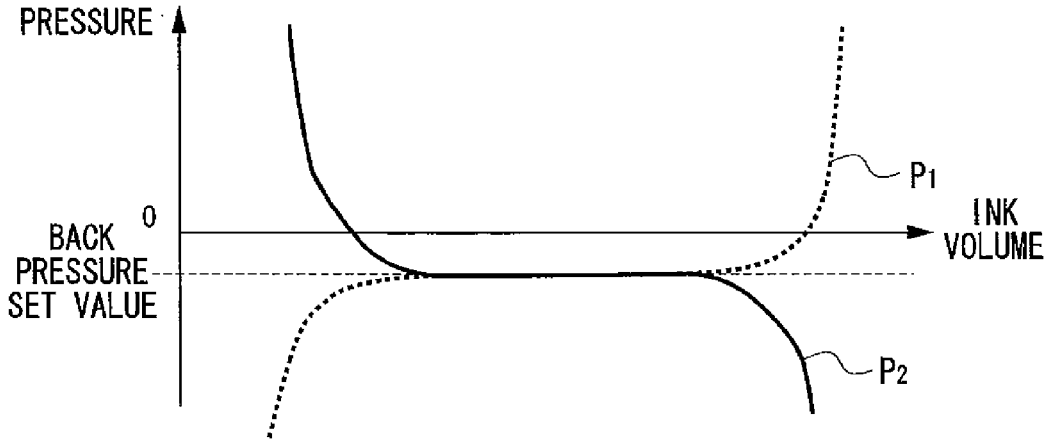
FIG. 3 is a diagram showing the relationship among the ink volume and pressure in the ink chamber and the pressure in a gas chamber, when a film membrane is used as a flexible film.
Figure 4:
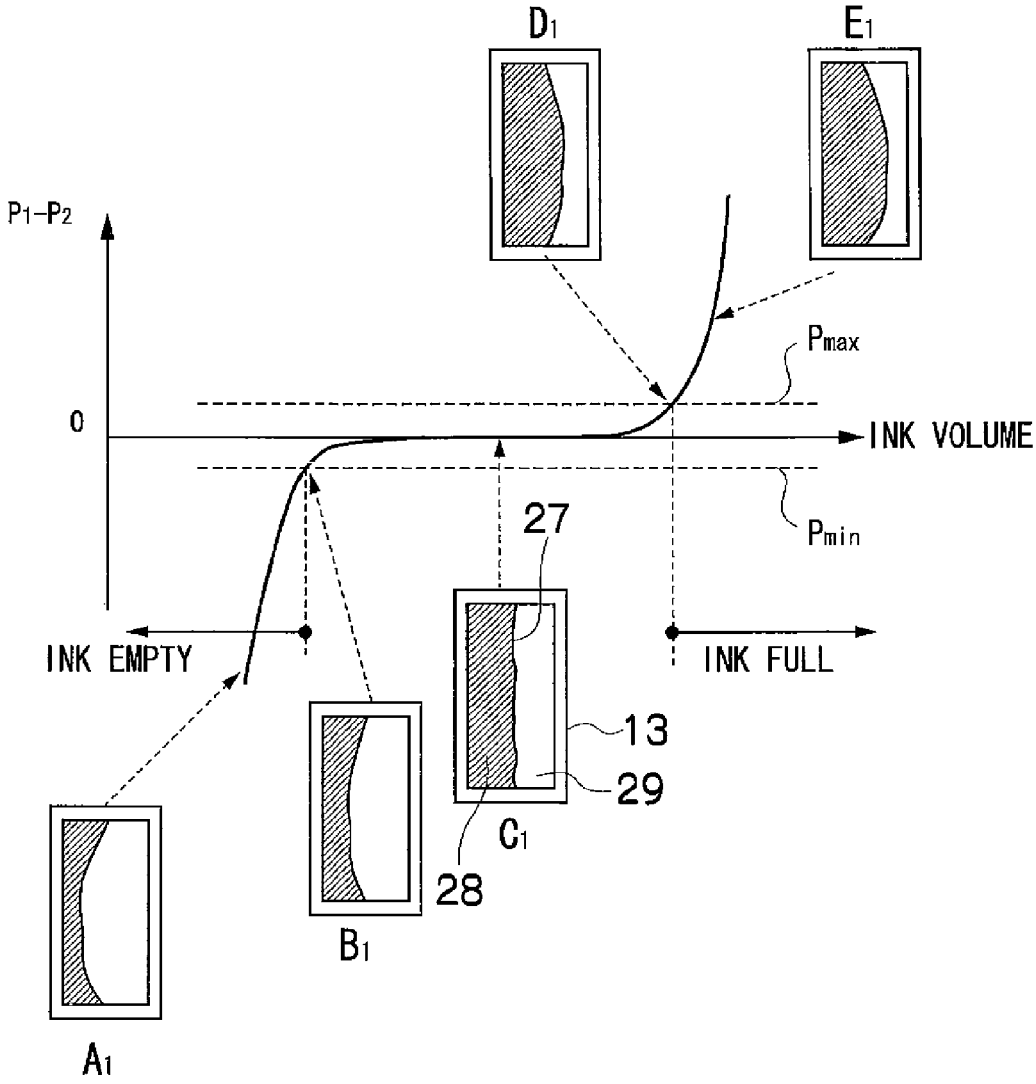
FIG. 4 is a diagram showing the relationship between the pressure differential and the amount of ink, when a film membrane is used as the flexible film.

Here, FIG. 3 is a diagram showing the relationship among the ink volume and the pressure $P_1$ inside the ink chamber 28 and the pressure $P_2$ inside the gas chamber 29, when a film membrane is used as the flexible film 27. FIG. 4 shows the state of the pressure differential between the pressure $P_1$ and the pressure $P_2$ which changes in response to the change in the ink volume, as shown in FIG. 3. In the present embodiment, judgment is made on the basis of this pressure differential ($P_1-P_2$). More specifically, as the volume of ink changes from a state where the flexible film 27 is stretched without receiving a load, the tension in the flexible film 27 increases, and when the flexible film 27 reaches a limit state where it has stretched to an extent where it can no longer bend freely (a state at the limit of the range where the back pressure of the ink inside the recording head 12 can be controlled by controlling the pressure in the gas chamber 29 and causing the flexible film 27 to bend freely), then an "ink empty" or "ink full" status is determined. The pressure differential may also be defined as ($P_2-P_1$).

Therefore, it is judged whether or not the condition $(P_1-P_2) \leqq P_{min}$ is satisfied in respect of the determined pressure differential ($P_1-P_2$) (step S2-2). $P_{min}$ is a limit value at which the flexible film 27 is stretched and can no longer bend freely, and it indicates the lower limit value of the tolerable range of the ink volume in the ink chamber 28 in which the back pressure of the ink inside the recording head 12 can be controlled.

If the conditions $(P_1-P_2) \leqq P_{min}$ are satisfied, then the ink volume in the ink chamber 28 is equal to or lower than the lowest value of the tolerable range in which the back pressure of the ink inside the recording head 12 can be controlled, and the status is judged as an "ink empty" status (step S2-3). The state of the flexible film 27 in the sub tank 13 at which it is judged as such an "ink empty" status, is represented by $A_1$ and $B_1$ in FIG. 4. As expressed by $A_1$ and $B_1$ in FIG. 4, the pressure of the gas chamber 29 becomes greater, and the amount of ink inside the ink chamber 28 declines. The flexible film 27 is pressed toward the ink chamber 28 and is stretched and becomes unable to bend freely.

On the other hand, if the condition $(P_1-P_2) \leqq P_{min}$ is not satisfied, then it is judged whether or not the condition $(P_1-P_2) \geqq P$ is satisfied (step S2-4). $P_{max}$ is a limit value at which the flexible film 27 is stretched and can no longer bend freely, and it indicates the upper limit value of the tolerable range of the ink volume in the ink chamber 28 in which the back pressure of the ink inside the recording head 12 can be controlled.

If the condition $(P_1-P_2) \geqq P_{max}$ is satisfied, then the ink volume is equal to or exceeds the upper limit value of the tolerable range in which the back pressure of the ink inside the recording head 12 can be controlled, and therefore the status is judged as an "ink full" status (step S2-5). The state of the flexible film 27 in the sub tank 13 at which it is judged as an "ink full" status is represented by $D_1$ and $E_1$ in FIG. 4. As shown by $D_1$ and $E_1$ in FIG. 4, the pressure of the gas chamber 29 becomes smaller, and the amount of ink inside the ink chamber 28 increases. The flexible film 27 is pressed toward the gas chamber 29 and is stretched and becomes unable to bend freely.

If the condition $(P_1-P_2) \geqq P_{max}$ is not satisfied, then it is judged that the ink volume is within the tolerable range in which the back pressure of the ink inside the recording head 12 can be controlled (step S2-6). The state of the flexible film 27 in the sub tank 13 when it is judged that the ink volume is within the tolerable range in which the back pressure of the ink inside the recording head 12 can be controlled is represented by $C_1$ in FIG. 4. As indicated by $C_1$ in FIG. 4, the ink chamber 28 and the gas chamber 29 are separated by the flexible film 27 in such a manner that the volume of ink inside the ink chamber 28 becomes a volume which allows the back pressure of the ink inside the recording head 12 to be controlled.

Here, the merits of performing judgment on the basis of the pressure differential $(P_1-P_2)$ will be described. As shown in FIG. 3, when a prescribed negative pressure value is designated as the back pressure setting used in the back pressure control, then each of the pressure $P_1$ in the ink chamber 28 and the pressure $P_2$ in the gas chamber 29 changes as shown in FIG. 3, in accordance with the ink volume.

More specifically, if the tolerable range is set as the ink volume range in which the pressure $P_1$ in the ink chamber 28 and the pressure $P_2$ in the gas chamber 29 assume the set back pressure value, then in the case of an ink volume which is lower than the tolerable range, it is not possible to control the pressure $P_1$ in the ink chamber 28 and the pressure $P_2$ in the gas chamber 29 to the set back pressure value, and hence the pressure $P_1$ in the ink chamber 28 becomes a negative pressure value which is larger than the set back pressure value, while the pressure $P_2$ in the gas chamber 29 becomes a value which is to the positive pressure side of the set back pressure value. Furthermore, if the ink volume is greater than the tolerable range, then it is not possible to control the pressure $P_1$ in the ink chamber 28 or the pressure $P_2$ in the gas chamber 29, to the set back pressure value, and the pressure $P_1$ in the ink chamber 28 becomes a value which is positive with respect to the set back pressure value, while the pressure $P_2$ in the gas chamber 29 becomes a negative pressure which is larger than the set back pressure value.

Here, as shown in FIG. 3, at an ink volume which is smaller than the tolerable range or an ink volume which is greater than the tolerable range, the amount of change (graph gradient) of the pressure $P_2$ in the gas chamber 29 with respect to the ink volume is greater than the amount of change (graph gradient) of the pressure $P_1$ in the ink chamber 28 with respect to the ink volume. This is because, in comparison with the pressure $P_1$ in the ink chamber 28 which is adjusted to a prescribed value, the pressure $P_2$ of the gas chamber 29 on the adjusting side acts against the tension of the flexible film 27, and therefore it rises more quickly. Therefore, using the pressure differential $(P_1-P_2)$ is thought to give better determination sensitivity and improve the judgment accuracy, and consequently judgment is made by determining the pressure differential $(P_1-P_2)$.

Figure 5:
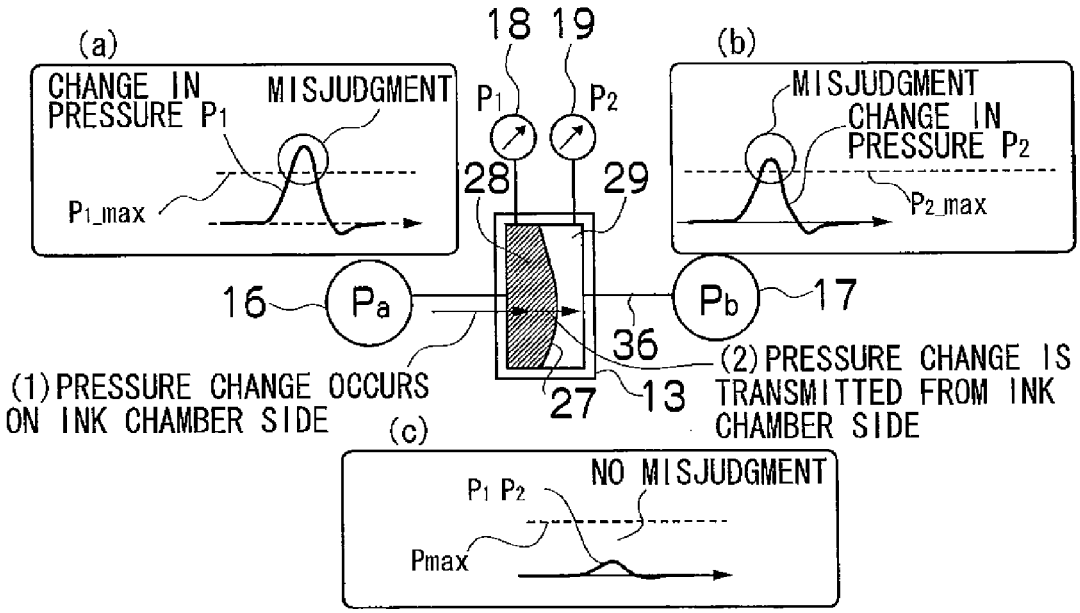
FIG. 5 is an illustrative diagram of merits of performing judgment on the basis of the determined pressure differential ($P_1$–$P_2$)

Furthermore, the following merits are thought to be obtained by making judgment through determining the pressure differential $(P_1-P_2)$. For example, as shown in FIG. 5, if a sudden pressure change has occurred in the pressure $P_1$ inside the ink chamber 28 (FIG. 5(*a*)) due to disturbance such as the pulsating action of the ink pump 16, or the like, then this is propagated also to the gas chamber 29 and a sudden pressure change occurs in the pressure $P_2$ in the gas chamber 29 also (FIG. 5(*b*)). In this case, if the ink storage amount in the ink chamber 28 of the sub tank 13 is determined on the basis of the pressure $P_1$ in the ink chamber 28 only, or the pressure $P_2$ in the gas chamber 29 only, then as shown in FIG. 5(*a*) or 5(*b*), there is a possibility that the value of the pressure $P_1$ in the ink chamber 28 or the value of the pressure $P_2$ in the gas chamber 29 exceeds the limit values of the tolerable range ($P_{1_max}$ and $P_{2_max}$), and the status is erroneously judged as an "ink empty" status or an "ink full" status.

On the other hand, if judgment is made by determining the pressure differential $(P_1-P_2)$, then the sudden pressure changes described above cancel each other out and there is no possibility of erroneous judgment in this regard (FIG. 5(*c*)). As described above, there are merits in performing judgment by determining the pressure differential $(P_1-P_2)$.

Furthermore, when the judgment is carried out on the basis of the pressure differential $(P_1-P_2)$, the pressure $P_1$ in the ink chamber 28 is determined with respect to each time. Therefore, in circumstances where there is a change in the ink volume in the ink chamber 28, such as during replenishment of ink from the ink tank 14 to the ink chamber 28, or during consumption of ink from the ink chamber 28, or the like, then there is a merit in that it is possible that an "ink empty" status, an "ink full" status, and a status where the ink volume is within a tolerable range which allows the back pressure of the ink to be controlled are determined.

The judgment process of the ink storage amount in the ink chamber 28 shown in FIG. 2 is carried out when the image forming apparatus comprising the liquid ejection apparatus is started up, during image formation (printing), and during maintenance.

Figure 6:
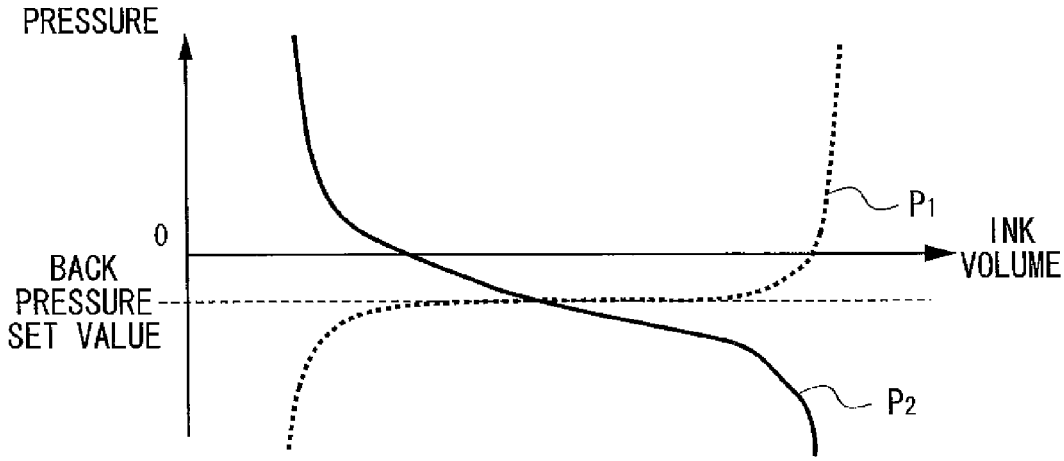
FIG. 6 is a diagram showing the relationship among the ink volume in the ink chamber and the pressure in the ink chamber, and the pressure in the gas chamber, when an elastic membrane is used as the flexible film.
Figure 7:
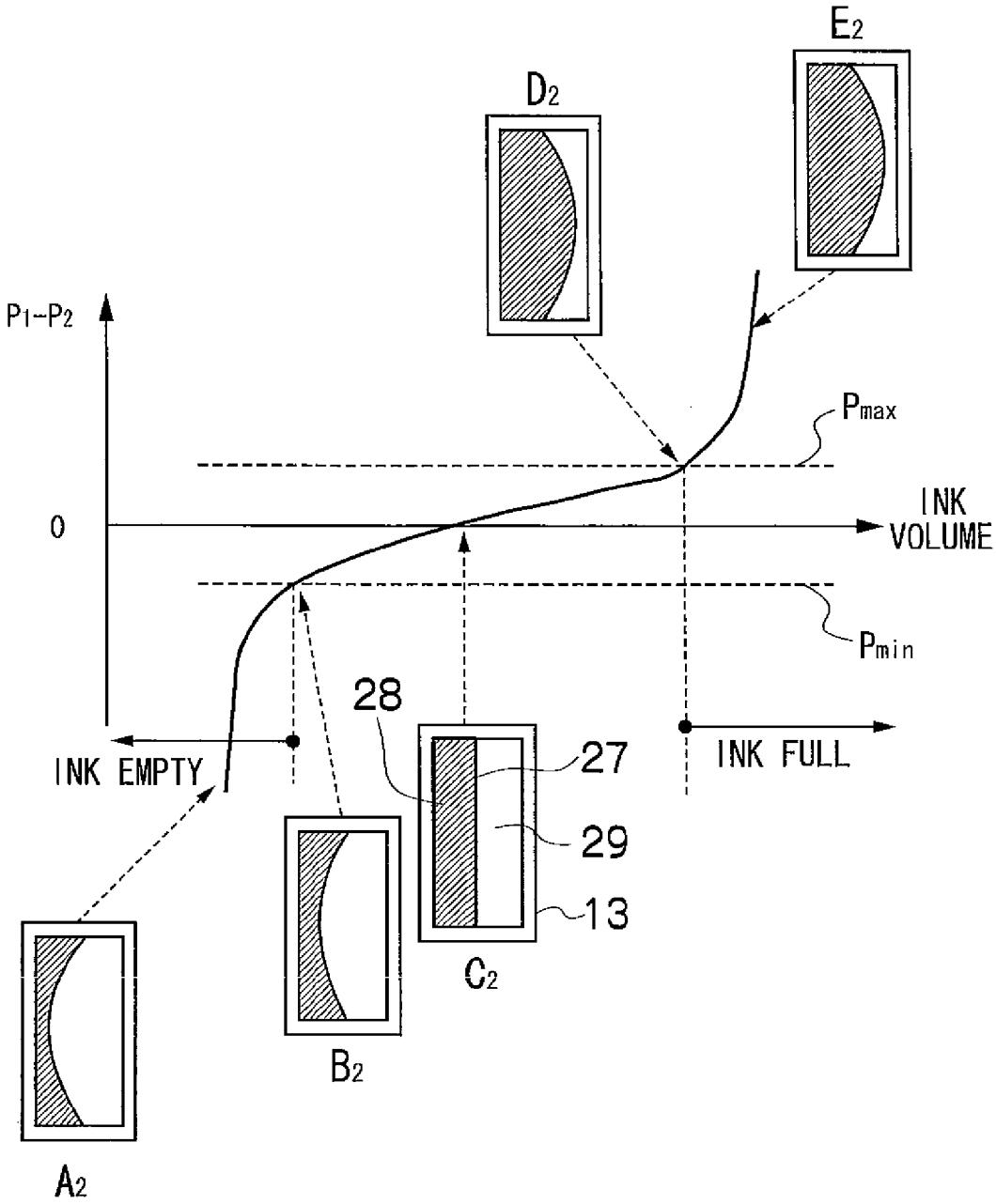
FIG. 7 is a diagram showing the relationship between the pressure differential and the amount of ink, when an elastic membrane is used as the flexible film.

Furthermore, it is possible to use an elastic membrane other than a film membrane as the flexible film 27. FIG. 6 is a diagram showing the relationship among the ink volume in the ink chamber 28 and the pressure $P_1$ inside the ink chamber 28 and the pressure $P_2$ inside the gas chamber 29, when an elastic membrane is used as the flexible film 27. FIG. 7 shows the state of the pressure differential between the pressure $P_1$ and the pressure $P_2$ which changes in response to the change in the ink volume as shown in FIG. 6. The method of judging the ink storage amount in the ink chamber 28 of the sub tank 13 is shown in FIG. 2 and is similar to that when a film membrane is used as the flexible film 27.

As shown in FIG. 6, if an elastic membrane is used as the flexible film 27, then since the flexible film 27 readily undergoes elastic deformation, it is necessary to control the pressure $P_2$ in the gas chamber 29 in such a manner that it changes more markedly in response to change in the ink volume in the ink chamber 28. When the ink volume inside the ink chamber 28 is within "a tolerable range in which the back-pressure control can be performed," pressure $P_1$ in the ink chamber 28 can be controlled uniformly to a preset back-pressure value, by control through more drastic change of pressure $P_2$ of the gas chamber 29, with respect to the change in the ink volume of the ink chamber 28.

Furthermore, when an elastic membrane is used as the flexible film 27, then the state of the flexible film 27 in the sub tank 13 when it is judged as an "ink empty" status is represented by $A_2$ and $B_2$ in FIG. 7. As indicated by $A_2$ and $B_2$ in FIG. 7, the pressure of the gas chamber 29 becomes greater, and the amount of ink inside the ink chamber 28 declines. The flexible film 27 is pressed toward the ink chamber 28 and is stretched and becomes unable to bend freely.

Furthermore, when an elastic membrane is used as the flexible film 27, then the state of the flexible film 27 in the sub tank 13 when it is judged as an "ink fill" status is represented by $D_2$ and $E_2$ in FIG. 7. As indicated by $D_2$ and $E_2$ in FIG. 7, the pressure of the gas chamber 29 becomes smaller, and the amount of ink inside the ink chamber 28 increases. The flexible film 27 is pressed toward the gas chamber 29 and is stretched and becomes unable to bend freely.

Furthermore, when an elastic membrane is used as the flexible film 27, the state of the flexible film 27 in the sub tank 13 when it is judged that the pressure differential is within the tolerable range in which the back pressure of the ink inside the recording head 12 can be controlled is represented by $C_2$ in FIG. 7. As indicated by $C_2$ in FIG. 7, the ink chamber 28 and the gas chamber 29 are separated by the flexible film 27 in such a manner that the volume of ink inside the ink chamber 28 becomes a volume which allows the back pressure of the ink inside the recording head 12 to be controlled.

Other than this, the features are the same as when a film membrane is used as the flexible film 27.

Control of Liquid Storage Amount

Figure 8:
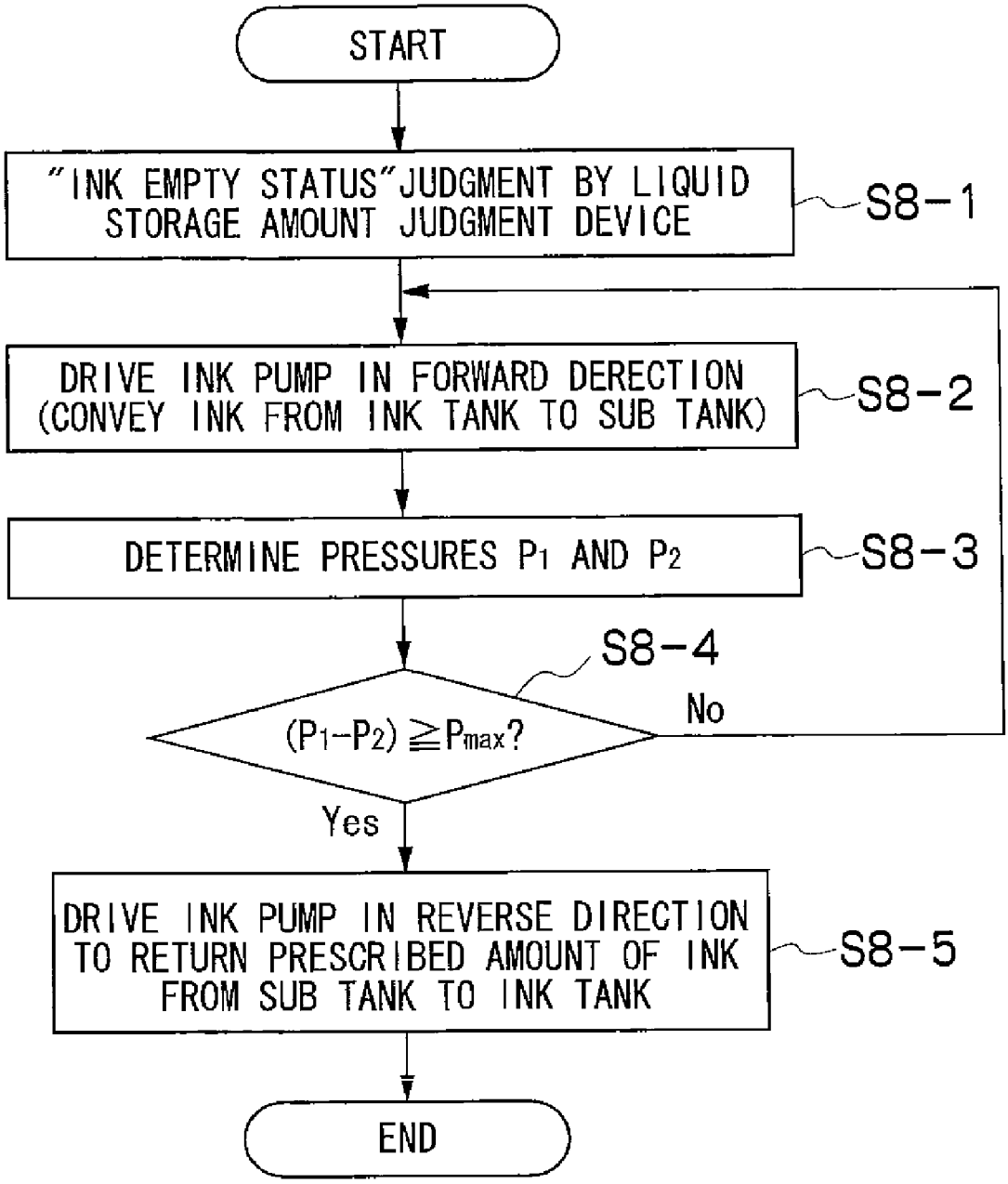
FIG. 8 is a flowchart diagram of a method of controlling the amount of ink in the ink chamber when the status is judged as an "ink empty" status by the liquid storage amount judgment device.
Figure 9:
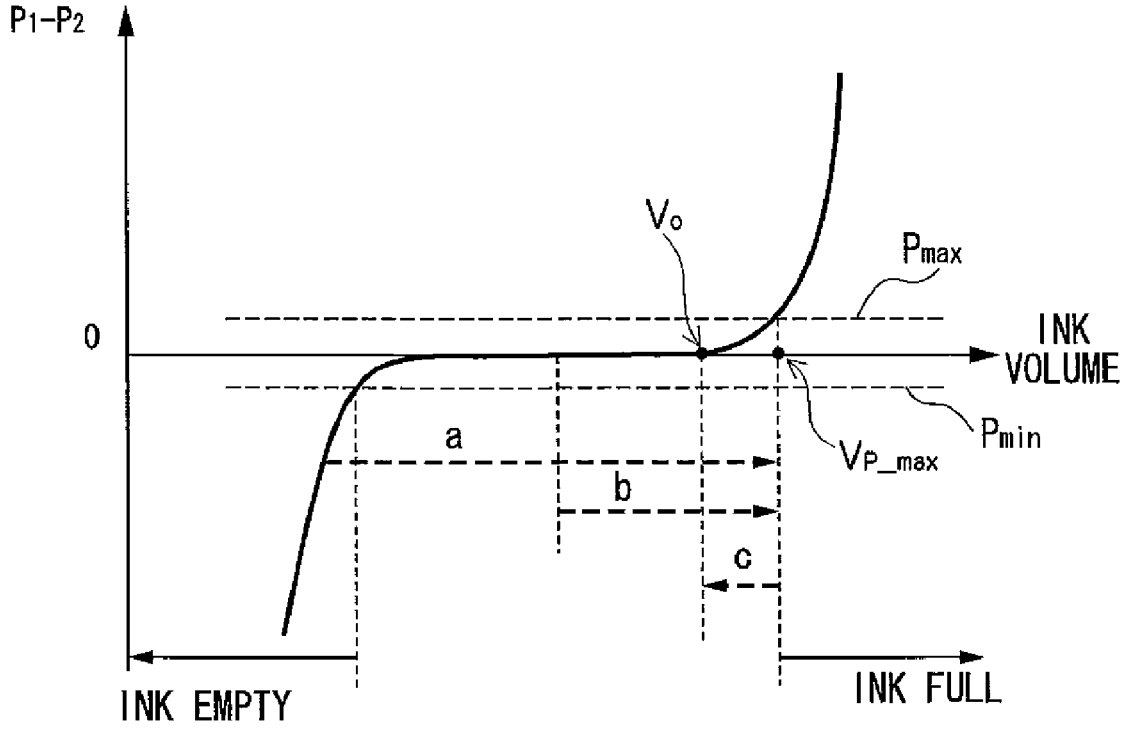
FIG. 9 is a diagram showing the procedures of controlling the amount of ink in the ink chamber, together with the relationship between the pressure differential and the amount of ink in the ink chamber.

FIG. 8 is a flowchart diagram of a method of controlling the amount of ink in the ink chamber 28 when the status is judged as an "ink empty" status by the liquid storage amount judgment device 21. Furthermore, FIG. 9 is a diagram showing the procedure of controlling the ink volume in the ink chamber 28, together with the relationship between the pressure difference $(P_1-P_2)$ and the ink volume in the ink chamber 28.

As shown in FIG. 8, a case is considered where the status is judged to be "ink empty" by the liquid storage amount judgment device 21 after the start of the procedure (step S8-1). In this case, the ink pump 16 is driven in the forward direction, and ink is conveyed from the ink tank 14 into the ink chamber 28 in the sub tank 13 (replenishment conveyance) (step S8-2). The speed of this conveyance may be controlled uniformly, or it may be controlled so as to change periodically. If the speed is controlled to a uniform speed, then the ink can be conveyed stably from the ink tank 14 to the ink chamber 28. Furthermore, by controlling the speed so as to change periodically, it is possible to apply a periodic variation to the flexible film 27 and therefore any bubbles or foreign material adhering thereto becomes more liable to be detached.

Next, the pressure $P_1$ in the ink chamber 28 is determined by the ink chamber pressure gauge 18, and the pressure $P_2$ in the gas chamber 29 is determined by the gas chamber pressure gauge 19 (step S8-3).

Next, the liquid storage amount judgment device 21 determines the pressure differential $(P_1-P_2)$ on the basis of the determination data for the pressure $P_1$ in the ink chamber 28 and the determination data for the pressure $P_2$ in the gas chamber 29. Then, in respect of the determined pressure differential $(P_1-P_2)$, it is judged whether or not the condition $(P_1-P_2)\geqq P_{max}$ is satisfied (step S8-4).

Here, if the condition $(P_1-P_2)\geqq P_{max}$ is not satisfied, then the ink pump 16 is driven the forward direction, ink is conveyed from the ink tank 14 to the ink chamber 28 in the sub tank 13, and this operation is repeated until the condition $(P_1-P_2)\geqq P_{max}$ is satisfied. These steps correspond to the step shown as (a) in FIG. 9.

If the condition $(P_1-P_2)\geqq P_{max}$ is satisfied, then the ink pump 16 is driven in reverse, and a prescribed amount of ink is returned (reverse conveyance) from the ink chamber 28 of the sub tank 13 to the ink tank 14 (step S8-5). This step S8-5 corresponds to the step shown as (c) in FIG. 9. By returning the prescribed amount of ink from the ink chamber 28 of the sub tank 13 to the ink tank 14 in this way, the load applied to the flexible film 27 is alleviated and the lifespan of the flexible film 27 can be increased.

Here, the "prescribed amount" is indicated by $(V_{P_max}-V_0)$, where $V_0$ is the ink volume required in the ink chamber 28, and $V_{P_max}$ is the ink volume in the ink chamber 28 when $(P_1-P_2)=P_{max}$, as determined from the relationship with the ink consumption volume at start up, during image formation (printing), and during maintenance, in an image forming apparatus comprising the liquid ejection apparatus according to an embodiment of the present invention, regardless of whether the flexible film 27 is a film membrane or an elastic membrane. In particular, if the flexible film 27 is a film membrane, then the ink volume $V_0$ required in the ink chamber 28 is desirably the maximum ink volume in the ink volume range which satisfies the condition of pressure differential $(P_1-P_2)=0$ (see FIG. 9).

Figure 10:
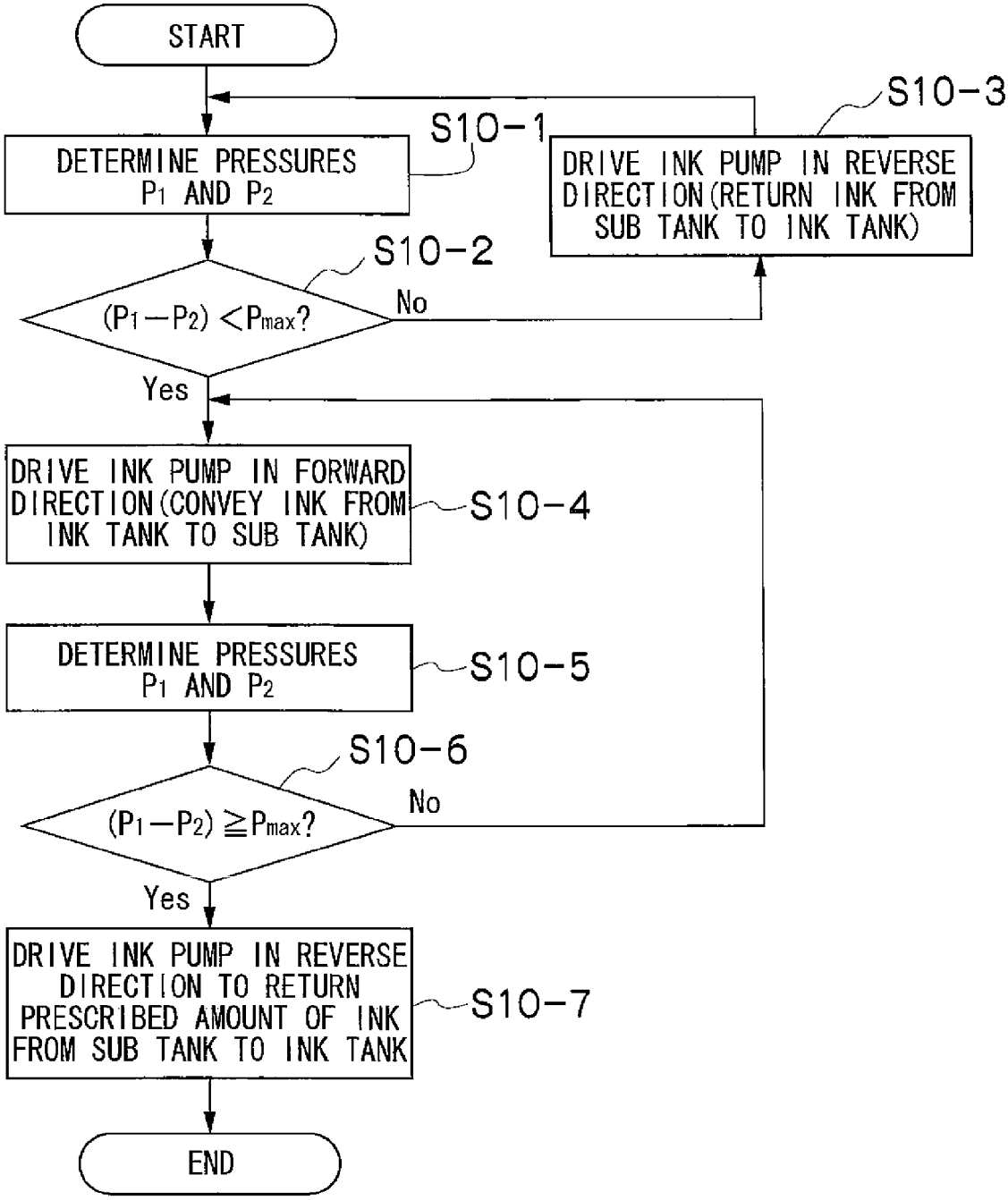
FIG. 10 is a flowchart diagram showing a method of controlling the ink volume in the ink chamber before an operation which consumes a large amount of ink (for instance, image formation or maintenance)

Furthermore, FIG. 10 is a flowchart diagram showing a method of controlling the ink volume in the ink chamber 28 before an operation which consumes a large amount of ink (for instance, image formation or maintenance).

As shown in FIG. 10, when the flowchart is started, firstly, the pressure $P_1$ inside the ink chamber 28 is determined by the ink chamber pressure gauge 18, and the pressure $P_2$ in the gas chamber 29 is determined by the gas chamber pressure gauge 19 (step S10-1).

Next, the liquid storage amount judgment device 21 determines the pressure differential $(P_1-P_2)$ on the basis of the determination data for the pressure $P_1$ in the ink chamber 28 and the determination data for the pressure $P_2$ in the gas chamber 29. Then, in respect of the determined pressure differential $(P_1-P_2)$, it is judged whether or not the condition $(P_1-P_2)<P_{max}$ is satisfied (step S10-2).

Here, if the condition $(P_1-P_2)<P_{max}$ is not satisfied, then the ink pump 16 is driven in the reverse direction, ink is returned from the sub tank 13 to the ink tank 14 (step S10-3), and this operation is repeated until the condition $(P_1-P_2)<P_{max}$ is satisfied.

Thereupon, when the condition $(P_1-P_2)<P_{max}$ is satisfied, the ink pump 16 is driven in the forward direction, and ink is conveyed from the ink tank 14 to the sub tank 13 (step S10-4).

Next, the pressure $P_1$ in the ink chamber 28 is determined by the ink chamber pressure gauge 18, and the pressure $P_2$ in the gas chamber 29 is determined by the gas chamber pressure gauge 19 (step S10-5).

Next, the liquid storage amount judgment device 21 determines the pressure differential $(P_1-P_2)$ on the basis of the determination data for the pressure $P_1$ in the ink chamber 28 and the determination data for the pressure $P_2$ in the gas chamber 29. Then, in respect of the determined pressure differential $(P_1-P_2)$, it is judged whether or not the condition $(P_1-P_2)\geqq P_{max}$ is satisfied (step S10-6).

Here, if the condition $(P_1-P_2)\geqq P_{max}$ is not satisfied, then the ink pump 16 is continuously driven the forward direction, ink is conveyed from the ink tank 14 into the ink chamber 28 in the sub tank 13, and this operation is repeated until the condition $(P_1-P_2)\geqq P_{max}$ is satisfied. These steps correspond to the step shown as (b) in FIG. 9.

If the condition $(P_1-P_2)\geqq P_{max}$ is satisfied, then the ink pump 16 is driven in reverse, and a prescribed amount of ink is returned (reverse conveyance) from the ink chamber 28 of the sub tank 13 to the ink tank 14 (step S10-7). This step S10-7 corresponds to the step shown as (e) in FIG. 9.

Here, the definition of the "prescribed amount" is defined similarly to that described above.

Judgment of State of Deterioration of Flexible Film

FIG. 11 is a flowchart of a method of judging the state of deterioration of the flexible film 27. As shown in FIG. 11, when the flowchart is started, firstly, the pressure $P_1$ in the ink chamber 28 is determined by the ink chamber pressure gauge 18, and the pressure $P_2$ in the gas chamber 29 is determined by the gas chamber pressure gauge 19 (step S11-1).

Next, the liquid storage amount judgment device 21 determines the pressure differential $(P_1-P_2)$ on the basis of the determination data for the pressure $P_1$ in the ink chamber 28 and the determination data for the pressure $P_2$ in the gas chamber 29. Then, in respect of the determined pressure differential $(P_1-P_2)$, it is judged whether or not the condition $(P_1-P_2)<P_{min}$ is satisfied (step S11-2).

Here, if the condition $(P_1-P_2)<P_{min}$ is not satisfied, then the ink pump 16 is driven in the reverse direction, ink is conveyed from the ink chamber 28 of the sub tank 13 to the ink tank 14, and this operation is repeated until the condition $(P_1-P_2)<P_{min}$ is satisfied (step S11-3).

Figure 12:
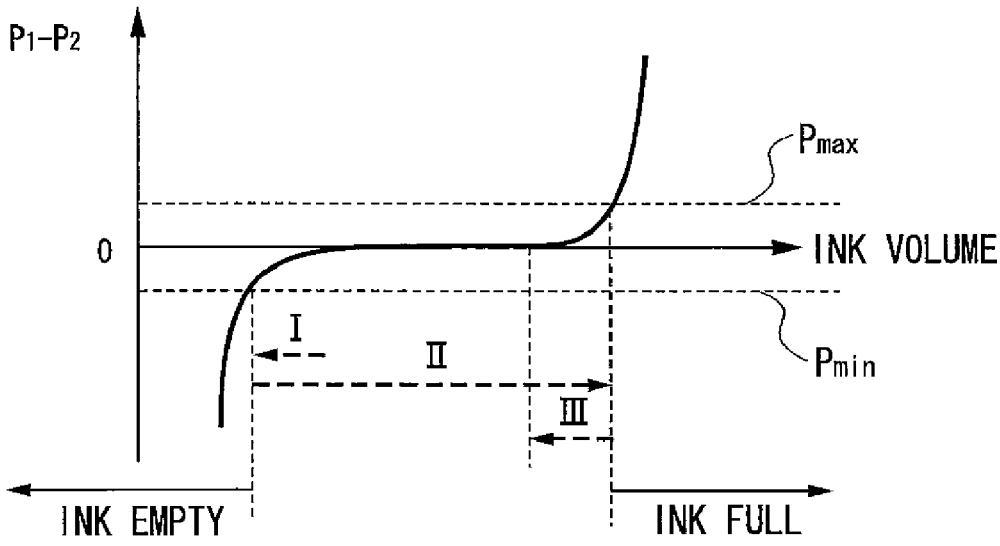
FIG. 12 is a diagram of the relationship between the pressure differential and the amount of ink in the ink chamber.

The sequence of the steps S11-2 and S11-3 described above (the region indicated by "I" in FIG. 11) can be represented by "I" in the graph relating the pressure differential $(P_1-P_2)$ and the ink volume in the ink chamber 28 shown in FIG. 12.

Thereupon, when the condition $(P_1-P_2)<P_{min}$ is satisfied, the ink pump 16 starts to be driven in the forward direction, and ink starts to be conveyed from the ink tank 14 to the sub tank 13 (step S11-4).

Next, the pressure $P_1$ in the ink chamber 28 is determined by the ink chamber pressure gauge 18, and the pressure $P_2$ in the gas chamber 29 is determined by the gas chamber pressure gauge 19 (step S11-5).

Next, the liquid storage amount judgment device 21 determines the pressure differential $(P_1-P_2)$ on the basis of the determination data for the pressure $P_1$ in the ink chamber 28 and the determination data for the pressure $P_2$ in the gas chamber 29. Then, in respect of the determined pressure differential $(P_1-P_2)$, it is judged whether or not the condition $(P_1-P_2)\geqq P_{min}$ is satisfied (step S11-6). The sequence is repeated until the condition $(P_1-P_2)\geqq P_{min}$ is satisfied.

Consequently, if the condition $(P_1-P_2)\geqq P_{min}$, is satisfied, then the timer formed with the liquid storage amount judgment device 21 is started so that time measurement is started (step S11-7).

Next, the pressure $P_1$ in the ink chamber 28 is determined by the ink chamber pressure gauge 18, and the pressure $P_2$ in the gas chamber 29 is determined by the gas chamber pressure gauge 19 (step S11-8).

Next, the liquid storage amount judgment device 21 determines the pressure differential $(P_1-P_2)$ on the basis of the determination data for the pressure $P_1$ in the ink chamber 28 and the determination data for the pressure $P_2$ in the gas chamber 29. Then, in respect of the determined pressure differential $(P_1-P_2)$, it is judged whether or not the condition $(P_1-P_2)\geqq P_{min}$ is satisfied (step S11-9). The sequence is repeated until the condition $(P_1-P_2)\geqq P_{min}$ is satisfied.

If, as a result, the condition $(P_1-P_2)\geqq P_{max}$ is satisfied, then the timer is stopped, and the time measurement is halted (step S11-10).

Thereupon, the driving of the ink pump 16 is halted (step S11-11).

The sequence of the steps S11-4 to S11-11 (the region indicated by "II" in FIG. 11) can be represented by "II" in the graph relating to the pressure differential $(P_1-P_2)$ and the ink volume in the ink chamber 28 shown in FIG. 12.

Next, the measured time t of the timer is recorded in a memory (not illustrated) formed with the flexible film deterioration judgment device 24 (step S11-12).

Thereupon, the ink pump 16 is driven in reverse, and a prescribed amount of ink is returned from the ink chamber 28 of the sub tank 13 to the ink tank 14 (step S11-13). The sequence of the step S11-13 (the region indicated by "III", in FIG. 11) can be represented by "III" in the graph relating the pressure differential $(P_1-P_2)$ and the ink volume in the ink chamber 28 shown in FIG. 12.

Figure 13:
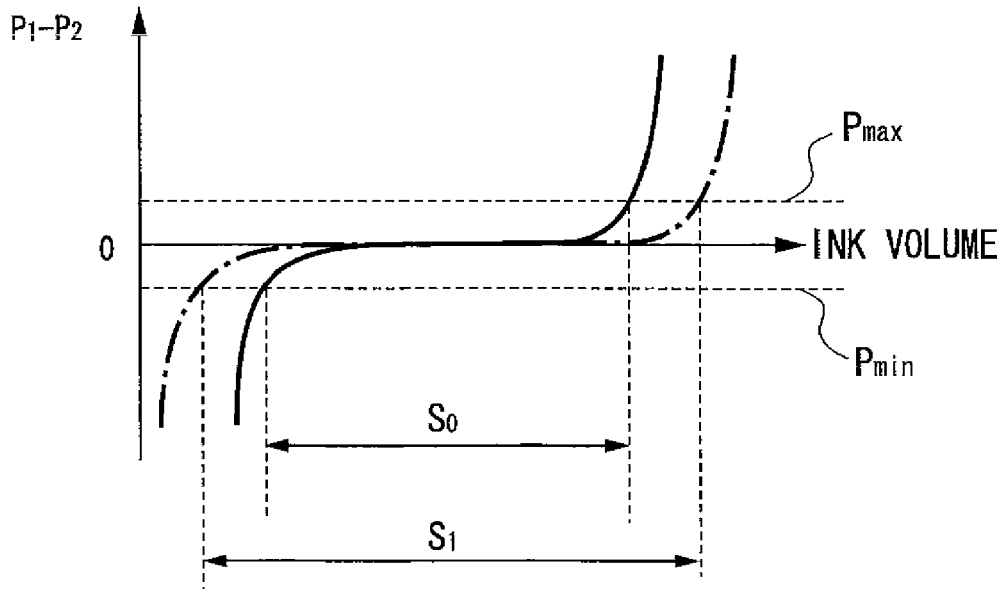
FIG. 13 is a diagram showing the relationship between the state of deterioration of the flexible film and the ink replenishment amount.

Next, it is judged whether or not the measured time t is equal to or greater than a prescribed value $T_L$ by the flexible film deterioration judgment device 24 (step S11-14). Here, as shown in FIG. 13, the ink replenishment amount corresponding to II in FIG. 12 changes with the state of deterioration of the flexible film 27. Therefore, if the ink replenishment amount provided by the ink pump 16 per unit time is uniform, then the time (measured time t) required in order to supply the ink replenishment amount corresponding to II in FIG. 12 changes with the state of deterioration of the flexible film 27. In FIG. 13, the ink replenishment amount $S_1$ in a case where the flexible film 27 is in an advanced state of deterioration is greater than the ink replenishment amount $S_0$ in a case where the state of deterioration of the flexible film 27 is not very advanced, and the measured time t in a case where the flexible film 27 is in an advanced state of deterioration is longer. In this embodiment of the present invention, the state of deterioration of the flexible film 27 is judged on the basis of the measured time t.

More specifically, if the measured time t is equal to or greater than the prescribed value $T_L$, then it is judged that the lifespan of the flexible film 27 has been reached, and the warning device 26 issues a warning that the replacement timing has been reached (step S11-15), whereupon the procedure ends. On the other hand, if the measured time t is less than the prescribed value $T_L$, then it is judged that the lifespan of the flexible film 27 has not yet been reached (step S11-16), and the procedure then ends.

Here, if the flexible film 27 is a film membrane, then the prescribed value $T_L$ is the measured time t when the film is in a state of having 5% to 20% extension, and if the flexible film 27 is an elastic membrane, then it is the measured time t when the tensile strength has fallen by 5% to 50%.

Figure 14:
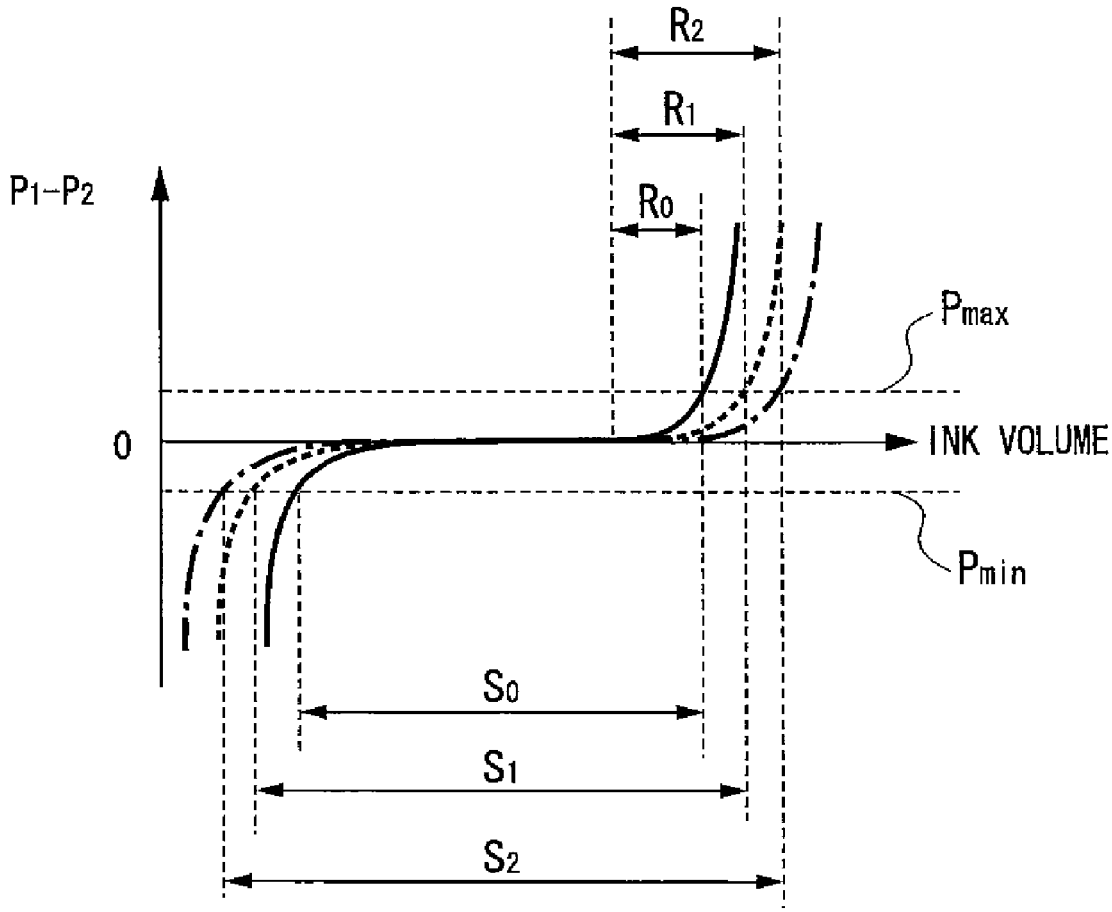
FIG. 14 is a diagram showing the relationship between the state of deterioration of the flexible film and the amount of ink returned from the sub tank to the ink tank.

In this way, the state of deterioration of the flexible film 27 is judged on the basis of the measured time t. When the ink pump 16 is driven in reverse so that the prescribed amount of ink has been returned to the ink tank 14 from the ink chamber 28 of the sub tank 13 as indicated in step S11-13, then desirably, the prescribed amount is changed as indicated by $R_0$, $R_1$, $R_2$ in FIG. 14. More specifically, desirably, the prescribed amount increases as the deterioration of the flexible film 27 advances, and thereby the load applied to the flexible film 27 is reduced. Consequently, it is possible to lessen the load on the flexible film 27, and to increase the lifespan of the film. Furthermore, it is also possible to achieve a uniform remaining amount of ink in the ink chamber 28.

Furthermore, as the deterioration of the flexible film 27 advances, the upper limit value $P_{max}$ and the lower limit value $P_{min}$ of the pressure differential $(P_1-P_2)$ at which the ink empty status or ink full status are determined may be reduced (changed so as to approach zero). Consequently, it is possible to lessen the load on the flexible film 27, and to increase the lifespan of the film.

The state of deterioration of the flexible film 27 is judged as shown in FIG. 11, when the image forming apparatus comprising the liquid ejection apparatus is started up and during maintenance.

It is possible to obtain the beneficial effects described below by means of the liquid ejection apparatus 11 according to the above-described embodiment of the present invention.

Since the liquid ejection apparatus comprises: a sub tank 13 having an ink chamber 28 which stores ink, a gas chamber 29 which fills with gas, and a flexible film 27 which divides the ink chamber 28 and the gas chamber 29; an ink tank 14 which stores ink and which is connected to the ink chamber 28; an ink pump 16 which conveys ink between the ink chamber 28 and the ink tank 14; a recording head 12 which is connected to the ink chamber 28; a controller 22 which controls the back pressure of the ink inside the recording head 12 by controlling the pressure in the gas chamber 29; an ink chamber pressure gauge 18 which determines the pressure $P_1$ of the ink chamber 28; a gas chamber pressure gauge 19 which determines the pressure $P_2$ of the gas chamber 29; and a liquid storage amount judgment device 21 which judges whether or not the amount of ink stored in the ink chamber 28 is within a tolerable range in which the back pressure in the recording head 12 can be controlled, on the basis of the pressure differential ($P_1-P_2$), which is the difference between the pressure $P_1$ in the ink chamber 28 determined by the ink chamber pressure gauge 18 and the pressure $P_2$ of the gas chamber 29 determined by the gas chamber pressure gauge 19; then even in circumstances where the ink storage amount in the ink chamber 28 changes, such as during replenishment of ink from the ink tank 14 to the ink chamber 28 of the sub tank 13, or during consumption of the ink which is ejected from the recording head 12, it is possible to judge whether or not the amount of ink stored in the ink chamber 28 is within a range in which the back pressure of the recording head 12 can be controlled, while maintaining judgment accuracy in respect of the ink storage amount.

Furthermore, the liquid storage amount judgment device 21 determines the range of the pressure differential ($P_1-P_2$) in which the flexible film 27 can bend freely (the range of $P_{min}$ to $P_{max}$), and when this pressure differential has exceeded the limit values ($P_{min}$, $P_{max}$) of the range ($P_{min}$ to $P_{max}$), it can determine that the amount of ink stored in the ink chamber 28 has reached a limit value ("ink empty" or "ink full") of the tolerable range in which the back pressure can be controlled.

Moreover, the controller 22 carries out replenishment supply for conveying ink from the ink tank 14 to the ink chamber 28 by means of the ink pump 16, and if it is judged by the liquid storage amount judgment device 21 that the ink storage amount in the ink chamber 28 has reached the upper limit value of the tolerable range in which the back pressure can be controlled, then the replenishment supply is halted, and by controlling the ink pump 16 in such a manner that a return supply is carried out for conveying ink from the ink chamber 28 to the ink tank 14, the load applied to the flexible film 27 is alleviated, and therefore it is possible to increase the lifespan of the flexible film 27, while achieving stable control of the back pressure.

Furthermore, the controller 22 is able to provide a stable supply of ink from the ink tank 14 to the ink chamber 28, by controlling the speed during the replenishment supply to a uniform speed. Furthermore, by controlling the speed so as to change periodically, it is possible to apply a periodic variation to the flexible film 27 and therefore any bubbles or foreign material adhering thereto becomes more liable to be detached.

Furthermore, the measured time t is determined, the measured time t being the time required for the ink storage amount in the ink chamber 28 to reach the upper limit value from the lower limit value of the tolerable range in which the back pressure can be controlled, by carrying out replenishment supply; and by providing a flexible film deterioration judgment device 24 which judges the state of deterioration of the flexible film 27 on the basis of the measured time t thus determined, then it is possible to determine the deterioration of the flexible film 27.

Furthermore, when the measured time t has exceeded the prescribed value $T_L$, the flexible film deterioration judgment device 24 judges that the flexible film 27 has reached an unusable state due to its deterioration, and therefore is able to determine the lifespan of the flexible film 27.

Moreover, it is also possible to use a warning device 26 which issues a warning that the replacement timing of the flexible film 27 has been reached, when it is judged by the flexible film deterioration judgment device 24 that the flexible film 27 is in an unusable state due to its deterioration.

Furthermore, the controller 22 controls the prescribed amount of the ink ($R_0$, $R_1$, $R_2$) in the return supply in accordance with the measured time t, and hence the load applied to the flexible film 27 is reduced, the lifespan can be increased, and the amount of ink in the ink chamber 28 can be kept to a uniform amount.

Composition of Inkjet Recording Apparatus

Next, an inkjet recording apparatus is described as a concrete example of the application of an image forming apparatus comprising the liquid ejection apparatus according to an embodiment of the present invention.

Figure 15:
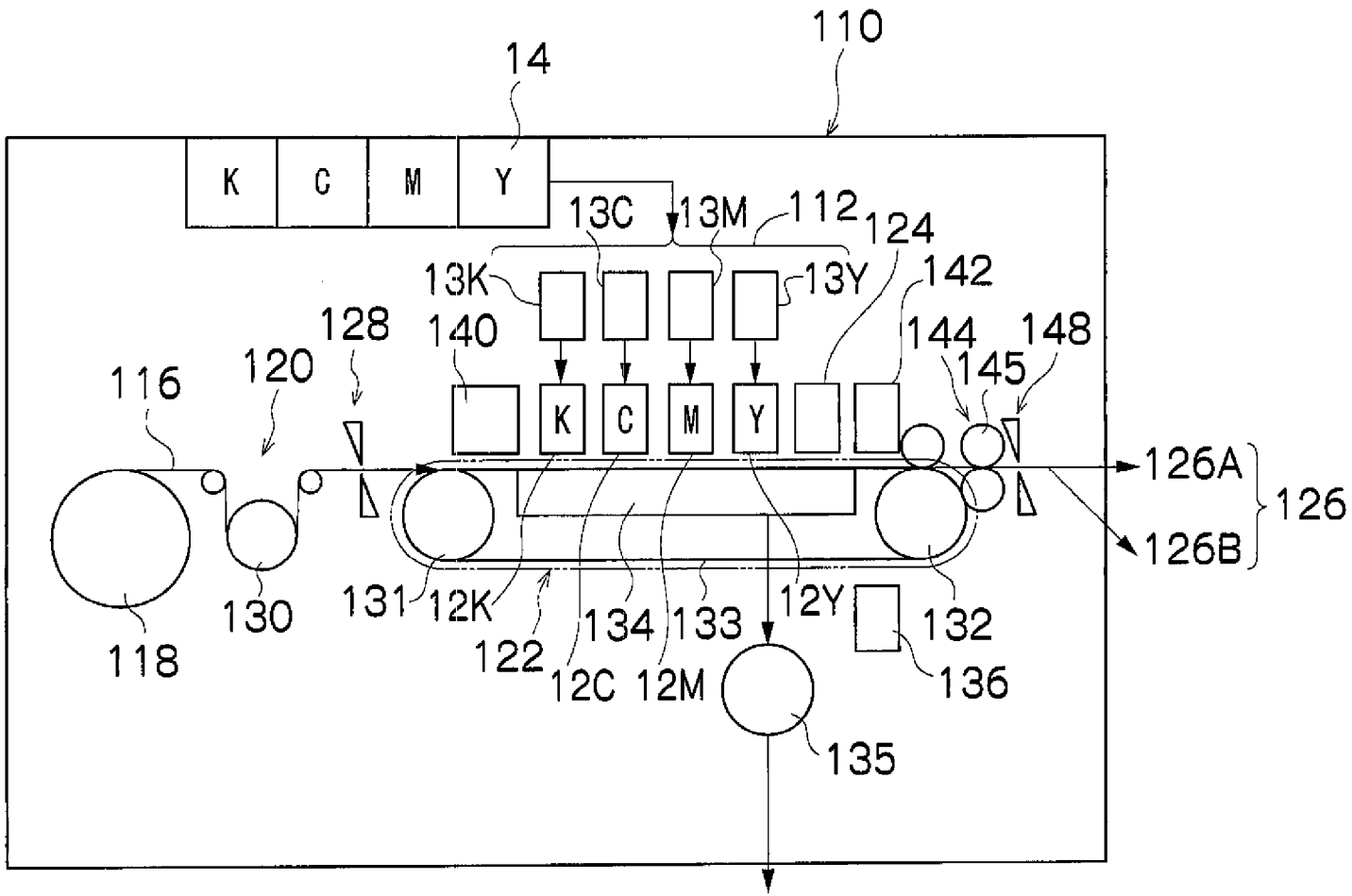
FIG. 15 is a general schematic drawing of an inkjet recording apparatus.

FIG. 15 is a general schematic drawing of an inkjet recording apparatus. The inkjet recording apparatus 110 comprises the liquid ejection apparatus 11 according to an embodiment of the present invention. FIG. 15 depicts, as parts of the liquid ejection apparatus 11 according to an embodiment of the present invention: a plurality of recording heads 12K, 12C, 12M, 12Y which are provided in accordance with the respective inks of the colors black (K), cyan (C), magenta (M), yellow (Y); a plurality of sub tanks 13K, 13C, 13M, 13Y provided to correspond to the respective recording heads; and an ink tank 14 which stores ink to be supplied to the respective sub tanks. The recording heads 12K, 12C, 12M, 12Y and the sub tanks 13K, 13C, 13M, 13Y are collectively termed the "printing unit 112".

Furthermore, the inkjet recording apparatus 110 comprises: a paper supply unit 118 which supplies recording paper 116, which is one example of a recording medium; a decurling unit 120 which removes curl from the recording paper 116; a belt conveyance unit 122 which conveys the recording paper 116 while keeping the recording paper 116 flat; a print determination unit 124 which reads in the print results from the printing unit 112; and a paper output unit 126 which outputs the recording paper on which recording has been performed (printed object), to the exterior.

The ink tank 14 stores inks of the colors corresponding to the respective sub tanks 13K, 13C, 13M and 13Y, and the respective tanks are connected to the sub tanks 13K, 13C, 13M and 13Y, via prescribed flow channels. The ink tank 14 also comprises a warning device (for example, a display device or an alarm sound generator) for warning when the remaining amount of any ink is low, and has a mechanism for preventing loading errors between different colors.

In FIG. 15, a magazine for rolled paper (continuous paper) is shown as an example of the paper supply unit 118; however, a plurality of magazines with paper differences such as paper width and quality may be jointly provided. Moreover, papers may be supplied with cassettes that contain cut papers loaded in layers and that are used jointly or in lieu of the magazine for rolled paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine.

In the case of the configuration in which roll paper is used, a cutter (first cutter) 128 is provided as shown in FIG. 15, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 15. The suction chamber 134 provides suction with a fan 135 to generate a negative pressure, and the recording paper 116 is held on the belt 133 by suction. It is also possible to use an electrostatic attraction method, instead of a suction-based attraction method.

Figure 16:
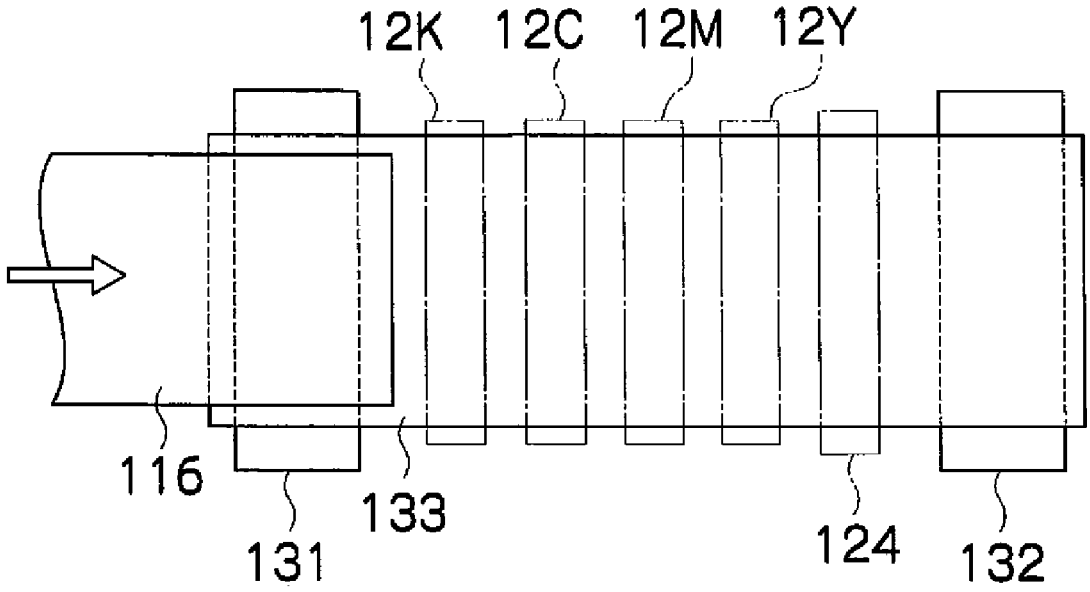
FIG. 16 is a plan view of a part of the peripheral area of a printing unit in the inkjet recording apparatus illustrated in FIG. 15.

The belt 133 is driven in the clockwise direction in FIG. 15 by the motive force of a motor (reference numeral 188 shown in FIG. 20) being transmitted to at least one of the rollers 131 and 132, which the belt 133 is set around, and the recording paper 116 held on the belt 133 is conveyed from left to right in FIG. 16.

Since ink adheres to the belt 133 when a marginless print job or the like is performed, a belt-cleaning unit 136 is disposed in a predetermined position (a suitable position outside the printing area) on the exterior side of the belt 133.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

The recording heads 12K, 12C, 12M and 12Y of the printing unit 112 are full line recording heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range).

The recording heads 12K, 12C, 12M and 12Y are arranged in color order (black (K), cyan (C), magenta (M), yellow (Y)) from the upstream side in the feed direction of the recording paper 116, and these respective recording heads 12K, 12C, 12M and 12Y are fixed extending in a direction substantially perpendicular to the conveyance direction of the recording paper 116.

A color image can be formed on the recording paper 116 by ejecting inks of different colors from the recording heads 12K, 12C, 12M and 12Y, respectively, onto the recording paper 116 while the recording paper 116 is conveyed by the belt conveyance unit 122.

By adopting a configuration in which the full line recording heads 12K, 12C, 12M and 12Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 shown in FIG. 15 has an image sensor (line sensor or area sensor) for capturing an image of the ink-droplet deposition result of the printing unit 112, and functions as a device to check the ejection characteristics, such as blockages, landing position error, and the like, of the nozzles, on the basis of the image of ejected droplets read in by the image sensor.

A two-dimensional array CCD area sensor in which a plurality of photoreceptor elements (photoelectric transducers) are arranged in the light receiving surface is suitable for use as the print determination unit 124 of the present example. An area sensor has an imaging range which is capable of capturing an image of at least the full area of the ink ejection width (image recording width) of the respective recording heads 12K, 12C, 12M and 12Y.

Furthermore, it is also possible to use a line sensor instead of the area sensor. In this case, a desirable composition is one in which the line sensor has rows of photoreceptor elements (rows of photoelectric transducing elements) with a width that is at least greater than the ink droplet ejection width (image recording width) of the recording heads 12K, 12C, 12M and 12Y. A test pattern or the target image printed by the recording heads 12K, 12C, 12M, and 12Y of the respective colors is read in by the print determination unit 124, and the ejection performed by each recording head is determined. The ejection determination includes detection of the ejection, measurement of the dot size, and measurement of the dot formation position.

A post-drying unit 142 is disposed following the print determination unit 124. The post-drying unit 142 is a device to dry the printed image surface, and includes a heating fan, for example.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are desirably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut to and separated by a cutter (second cutter) 148.

Structure of the Recording Head

Next, the structure of a recording head will be described. The recording heads 12K, 12C, 12M and 12Y of the respective ink colors have the same structure, and a reference numeral 150 is designated to any of the recording heads.

Figure 17A:
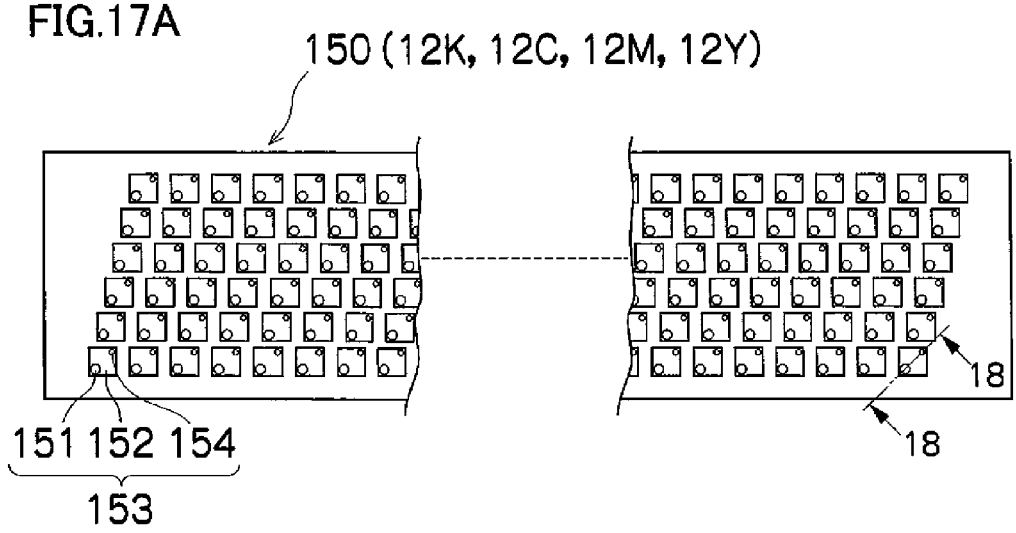
FIGS. 17A to 17C are plan view perspective diagrams showing examples of the structure of a recording head.
Figure 17B:
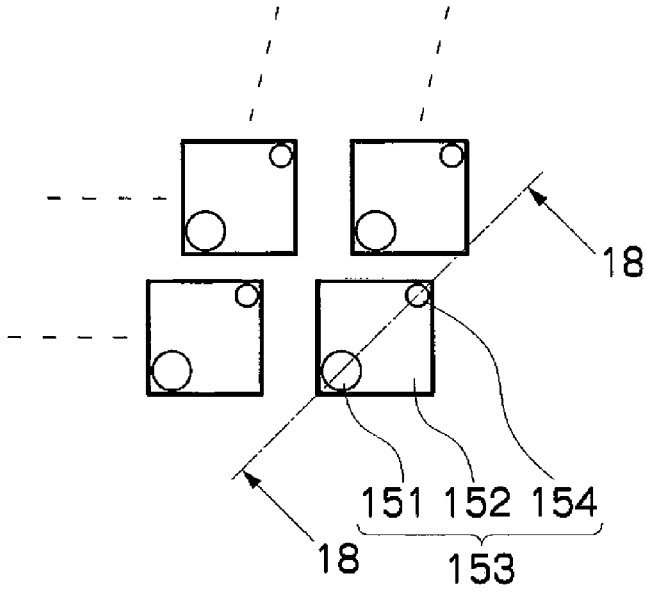
Figure 17C:
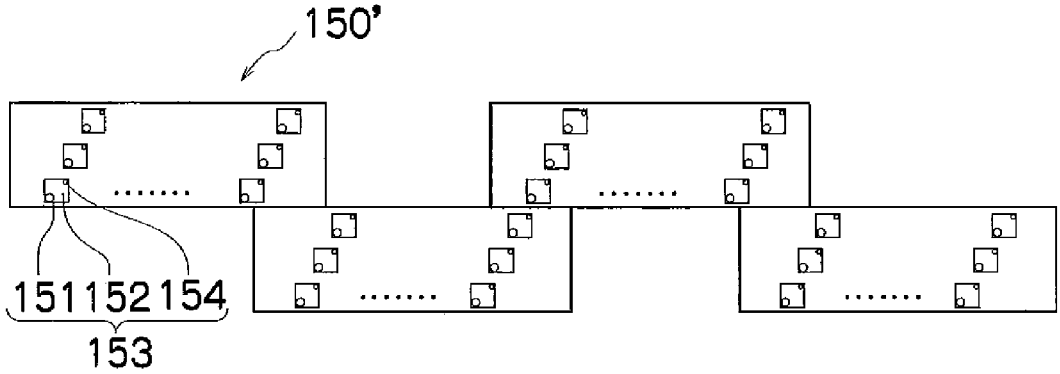
Figure 18:
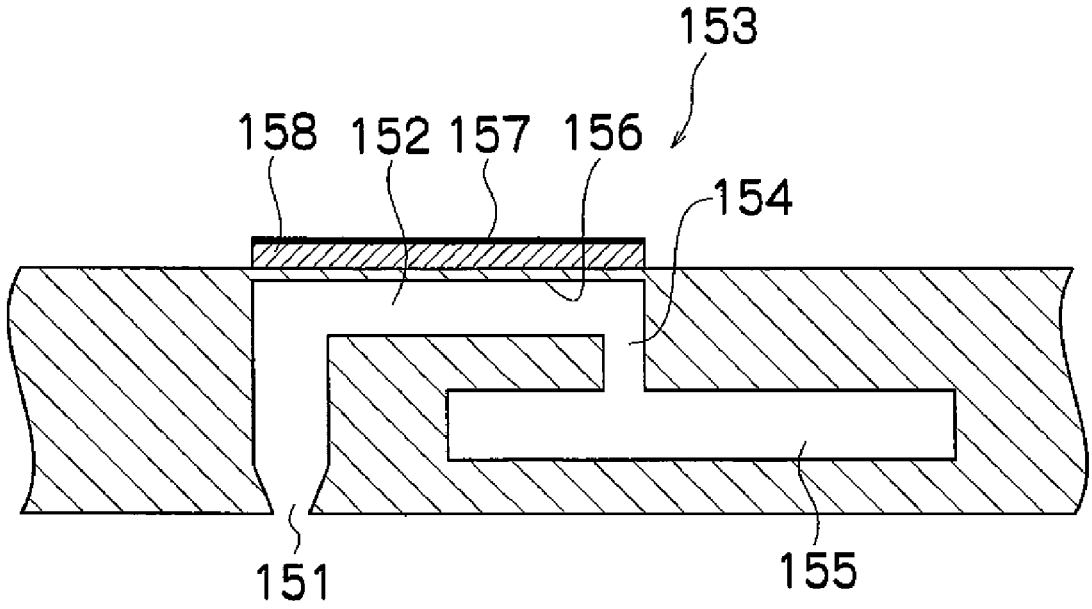
FIG. 18 is a cross-sectional view along line 18-18 in FIGS. 17A and 17B.

FIG. 17A is a perspective plan view showing an example of the configuration of the recording head 150, FIG. 17B is an enlarged view of a portion thereof, FIG. 17C is a perspective plan view showing another example of the configuration of the recording head, and FIG. 18 is a cross-sectional view taken along the line 18-18 in FIGS. 17A and 17B, showing the inner structure of a droplet ejection element (an ink chamber unit for one nozzle 151).

The nozzle pitch in the recording head 150 should be minimized in order to maximize the density of the dots printed on the surface of the recording paper 116. As shown in FIGS. 17A and 17B, the recording head 150 according to this example has a structure in which a plurality of ink chamber units 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the recording head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the example described above. For example, instead of the configuration in FIG. 17A, as shown in FIG. 17C, a line head having nozzle rows of a length corresponding to the entire width of the recording paper 116 can be formed by arranging and combining, in a staggered matrix, short head modules 150' having a plurality of nozzles 151 arrayed in a two-dimensional fashion.

As shown in FIGS. 17A and 17B, the planar shape of the pressure chamber 152 provided for each nozzle 151 is substantially a square, and an outlet to the nozzle 151 is disposed at one corner on a diagonal line of the square and a supply port 154 that is an inlet of supplied ink is disposed at the other corner on this diagonal line. The shape of the pressure chamber 152 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

The ink chamber unit 153 is constituted by a supply port 154, a pressure chamber 152, a nozzle 151, a pressurization plate 156, an individual electrode 157, an actuator 158, and the like. The respective pressure chambers 152 of the plurality of ink chamber units 153 are connected to a common flow channel 155. As shown in FIG. 18, each pressure chamber 152 is connected to the common channel 155 through the supply port 154. The common channel 155 is connected to an ink tank, which is a base tank that supplies ink, and the ink supplied from the ink tank is delivered through the common flow channel 155 to the pressure chambers 152.

Actuators 158 each provided with an individual electrode 157 are bonded to a pressure plate 156 (a diaphragm that also serves as a common electrode) which forms the surface of one portion (in FIG. 18, the ceiling) of the pressure chambers 152. When a drive voltage is applied to the individual electrode 157 and the common electrode, the actuator 158 is deformed, the volume of the pressure chamber 152 is thereby changed, and the pressure in the pressure chamber 152 is thereby changed, so that the ink inside the pressure chamber 152 is ejected through the nozzle 151. For the actuators 158, it is possible to adopt a piezoelectric element using a piezoelectric body, such as lead zirconate titanate, barium titanate, or the like.

When the displacement of the actuator 158 returns to its original position after ejecting ink, the pressure chamber 152 is replenished with new ink from the common flow channel 155, via the supply port 154.

Figure 19:
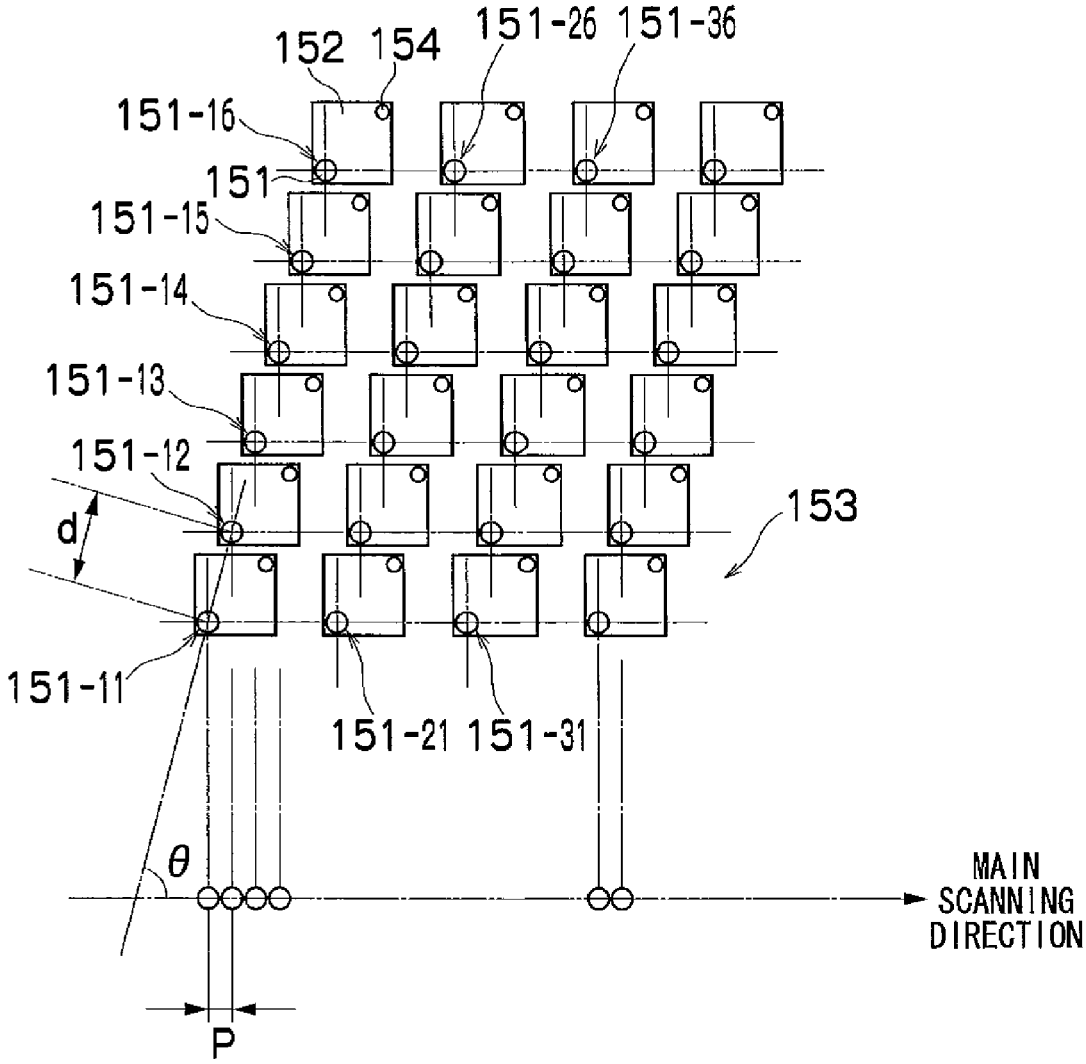
FIG. 19 is an enlarged diagram showing an example of the arrangement of nozzles in a recording head.

As shown in FIG. 19, the high-density nozzle head according to this example is achieved by arranging a plurality of ink chamber units 153 having the above-described stricture in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 153 are arranged at a uniform pitch d in line with a direction forming an angle of θ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 19 are driven, the main scanning according to the above-described (3) method is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the recording paper 116 by sequentially driving the nozzles 151-11, 151-12, 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by the main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator 158, which is typically a piezoelectric element; however, in implementing embodiments of the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 20:
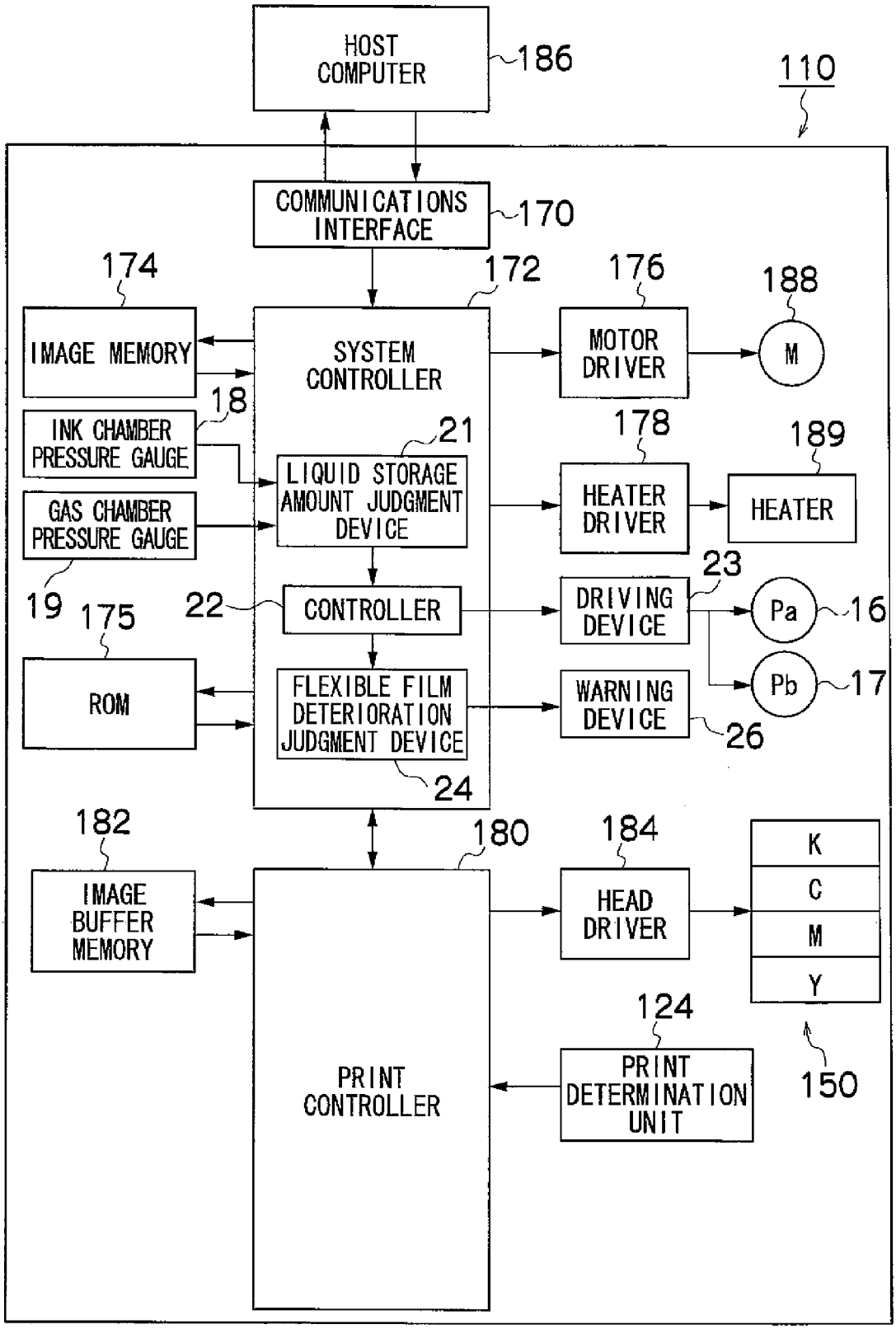
FIG. 20 is a block diagram showing a system composition of the inkjet recording apparatus.

FIG. 20 is a block diagram showing a system composition of the inkjet recording apparatus 110. As shown in FIG. 20, the inkjet recording apparatus 110 comprises a communications interface 170, a system controller 172, an image memory 174, a ROM 175, a motor driver 176, a heater driver 178, a print controller 180, an image buffer memory 182, a head driver 184, and the like.

The communications interface 170 is an interface unit (image input unit) which functions as an image input device for receiving image data transmitted from the host computer 186. A serial interface such as USB (Universal Serial Bus), IEEE1394, Ethernet (registered trademark), wireless network, or a parallel interface such as a Centronics interface may be used as the communications interface 170. A buffer memory (not shown) may be mounted in this portion in order to increase the communication speed.

The image data sent from the host computer 186 is received by the inkjet recording apparatus 110 through the communications interface 170, and is temporarily stored in the image memory 174. The image memory 174 is a storage device for storing images inputted through the communications interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with prescribed programs, as well as a calculation device for performing various calculations. More specifically, the system controller 172 controls the various sections, such as the communications interface 170, image memory 174, motor driver 176, heater driver 178, and the like, as well as controlling communications with the host computer 186 and writing and reading to and from the image memory 174 and ROM 175, and it also generates control signals for controlling the motor 188 and heater 189 of the conveyance system.

Furthermore, the system controller 172 internally comprises the liquid storage amount judgment device 21, the controller 22 and the flexible film deterioration judgment device 24, and it controls the drive device 23 and the warning device 26.

Programs executed by the CPU of the system controller 172 and the various types of data which are required for control procedures are stored in the ROM 175. The ROM 175 may be a non-writeable storage device, or it may be a rewriteable storage device, such as an EEPROM.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 and the like in accordance with commands from the system controller 172.

The print controller 180 is a control unit which functions as a signal processing device for performing various treatment processes, corrections, and the like, in accordance with the control implemented by the system controller 172, in order to generate a signal for controlling droplet ejection from the image data (multiple-value input image data) in the image memory 174, as well as functioning as a drive control device which controls the ejection driving of the recording head 150 by supplying the ink ejection data thus generated to the head driver 184.

The image buffer memory 182 is provided in the print controller 180, and image data, parameters, and other data are temporarily stored in the image buffer memory 182 when image data is processed in the print controller 180. FIG. 20 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is input from an external source via the communications interface 170, and is accumulated in the image memory 174. At this stage, multiple-value RGB image data is stored in the image memory 174, for example.

The print controller 180 performs processing for converting the input RGB image data into dot data for the four colors of K, C, M and Y. The dot data generated by the print controller 180 in this way is stored in the image buffer memory 182. This dot data of the respective colors is converted into CMYK droplet ejection data for ejecting ink from the nozzles of the recording heads 150, thereby establishing the ink ejection data to be printed.

The head driver 184 outputs drive signals for driving the actuators 158 corresponding to the nozzles 151 of the recording heads 150 in accordance with the print contents, on the basis of the ink ejection data and the drive waveform signals supplied by the print controller 180. A feedback control system for maintaining constant drive conditions in the head may be included in the head driver 184.

By supplying the drive signals output by the head driver 184 to the recording heads 150 in this way, ink is ejected from the corresponding nozzles 151. By controlling ink ejection from the recording heads 150 in synchronization with the conveyance speed of the recording paper 116, an image is formed on the recording paper 116.

As described above, the recording volume and the ejection timing of the ink droplets from the respective nozzles are controlled via the head driver 184, on the basis of the ink ejection data and the drive signal waveform generated by implementing required signal processing in the print controller 180. By this means, desired dot sizes and dot positions can be achieved.

The print determination unit 124 is a block that includes the image sensor as described above with reference to FIG. 15, reads the image printed on the recording paper 116, determines the print conditions (presence of the ejection, variation in the dot formation, optical density, and the like) by performing required signal processing, or the like, and provides the determination results of the print conditions to the print controller 180.

The print controller 180 implements various corrections with respect to the recording head 150, on the basis of the information obtained from the print determination unit 124, according to requirements, and it implements control for carrying out cleaning operations (nozzle restoring operations), such as preliminary ejection, suctioning, or wiping, as and when necessary.

Liquid droplet ejection apparatuses, image forming apparatuses and liquid storage amount judgment methods according to embodiments of the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a sub tank having a liquid chamber which stores liquid, a gas chamber which fills with gas, and a flexible film which divides the liquid chamber from the gas chamber;

a liquid tank which is connected to the liquid chamber and stores the liquid;

a liquid conveyance device which conveys the liquid between the liquid chamber and the liquid tank;

an ejection head connected to the liquid chamber;

a control device which carries out control in such a manner that pressure in the gas chamber is controlled to control back pressure of the liquid in the ejection head;

a liquid pressure determination device which determines pressure in the liquid chamber;

a gas pressure determination device which determines the pressure in the gas chamber; and a liquid storage amount judgment device which judges whether or not an amount of the liquid stored in the liquid chamber is within a tolerable range in which the back pressure of the liquid in the ejection head can be controlled, according to a gas-liquid pressure differential which is a difference between the pressure of the liquid chamber determined by the liquid pressure determination device and the pressure of the gas chamber determined by the gas pressure determination device.

2. The liquid ejection apparatus as defined in claim 1, wherein the liquid storage amount judgment device sets a range of the gas-liquid pressure differential in which the flexible film can bend freely, and judges that the amount of the liquid stored in the liquid chamber reaches a limit value of the tolerable range, when the gas-liquid pressure differential exceeds a limit value of the set range.

3. The liquid ejection apparatus as defined in claim 2, wherein:

the liquid conveyance device carries out replenishment supply to convey the liquid from the liquid tank to the liquid chamber, and return supply to convey the liquid from the liquid chamber to the liquid tank; and when the liquid storage amount judgment device judges that the amount of the liquid stored in the liquid chamber has reached an upper limit value of the tolerable range due to the replenishment supply, the control device carries out the control in such a manner that the liquid conveyance device halts the replenishment supply and carries out the return supply.

4. The liquid ejection apparatus as defined in claim 3, wherein the control device carries out the control in such a manner that a speed of the liquid conveyed from the liquid tank to the liquid chamber during the replenishment supply is substantially uniform or is varied periodically.

5. The liquid droplet ejection apparatus as defined in claim 3, further comprising a flexible film deterioration judgment device which determines liquid replenishment time that is a time period required for the amount of the liquid stored in the liquid chamber to vary from a lower limit value to an upper limit value of the tolerable range by means of the replenishment supply, and which judges a state of deterioration of the flexible film according to the determined liquid replenishment time.

6. The liquid ejection apparatus as defined in claim 5, wherein, when the liquid replenishment time exceeds a prescribed value $T_L$, the flexible film deterioration judgment device judges that a lifespan of the flexible film is reached in terms of the state of deterioration of the flexible film.

7. The liquid ejection apparatus as defined in claim 6, further comprising a warning device which issues a warning that replacement timing of the flexible film is reached, when the flexible film deterioration judgment device judges that the lifespan of the flexible film is reached in terms of the state of deterioration of the flexible film.

8. The liquid ejection apparatus as defined in claim 5, wherein the control device controls an amount of the liquid conveyed in the return supply in accordance with the liquid replenishment time.

9. An image forming apparatus comprising the liquid ejection apparatus defined in claim 1.

* * * * *